US007511707B2

(12) United States Patent
Ito et al.

(10) Patent No.: US 7,511,707 B2
(45) Date of Patent: Mar. 31, 2009

(54) METHOD AND CIRCUIT FOR DRIVING A PLASMA DISPLAY PANEL AND A PLASMA DISPLAY DEVICE

(75) Inventors: Kazuhiro Ito, Suwon-si (KR); Jun-Hyung Kim, Suwon-si (KR); Byung-Gwon Cho, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 500 days.

(21) Appl. No.: 11/133,478

(22) Filed: May 18, 2005

(65) Prior Publication Data

US 2006/0007063 A1 Jan. 12, 2006

(30) Foreign Application Priority Data

May 25, 2004 (KR) ..... 10-2004-0037273

(51) Int. Cl.
*G09G 5/00* (2006.01)

(52) U.S. Cl. ..... 345/204; 345/60; 345/61; 345/62; 345/63

(58) Field of Classification Search ..... 345/204, 345/37, 60–63
See application file for complete search history.

(56) References Cited

U.S. PATENT DOCUMENTS

| | | | | |
|---|---|---|---|---|
| 5,517,207 | A * | 5/1996 | Kawada et al. | 345/78 |
| 5,745,086 | A | 4/1998 | Weber | |
| 6,559,815 | B1 | 5/2003 | Kang et al. | |

FOREIGN PATENT DOCUMENTS

| | | |
|---|---|---|
| CN | 1445739 A | 10/2003 |
| CN | 1450514 A | 10/2003 |
| JP | 8-320667 | 12/1996 |
| JP | 11-65516 | 3/1999 |
| JP | 11-149274 | 6/1999 |
| JP | 2000-75835 | 3/2000 |
| JP | 2000-122603 | 4/2000 |
| JP | 2001-35395 | 2/2001 |
| JP | 2001-75526 | 3/2001 |

(Continued)

OTHER PUBLICATIONS

Korean Patent Abstracts for Publication No. 1020030027173, Date of publication of application Apr. 7, 2003, in the name of Seong Won Ji.

(Continued)

*Primary Examiner*—Richard Hjerpe
*Assistant Examiner*—Leonid Shapiro
(74) *Attorney, Agent, or Firm*—Christie, Parker & Hale, LLP

(57) ABSTRACT

According to an exemplary driving method of a plasma display panel of the present invention, waveforms having a reset function, an address function, and a sustain discharge function are applied to a scan electrode while sustain electrodes are biased at a ground voltage. A board for driving the sustain electrodes and a switch for supplying a ground voltage is eliminated and accordingly manufacturing cost of driving boards is reduced. Various circuits for generating the desirable waveforms and simplifications that do not compromise the effectiveness of the circuits are also presented.

8 Claims, 16 Drawing Sheets

FOREIGN PATENT DOCUMENTS

| | | | |
|---|---|---|---|
| JP | 2001-318649 | | 11/2001 |
| JP | 2002-14650 | | 1/2002 |
| JP | 2002-62844 | | 2/2002 |
| JP | 2003-50563 | | 2/2003 |
| KR | 2003-0027173 | | 4/2003 |
| KR | 1020030027273 | A * | 4/2003 |

OTHER PUBLICATIONS

Patent Abstracts of Japan; Publication No. 08-320667, dated Dec. 3, 1996 in the name of Giichi Kanazawa.
Patent Abstracts of Japan; Publication No. 11-065516, dated Mar. 9, 1999 in the name of Takeo Masuda et al.
Patent Abstracts of Japan; Publication No. 11-149274, dated Jun. 2, 1999 in the name of Yasutaka Inanaga.
Patent Abstracts of Japan; Publication No. 2000-075835, dated Mar. 14, 2000 in the name of Noriaki Setoguchi et al.
Patent Abstracts of Japan; Publication No. 2000-122603, dated Apr. 28, 2000 in the name of Hideyuki Asai et al.
Patent Abstracts of Japan; Publication No. 2001-035395, dated Feb. 9, 2001 in the name of Kyoung Ho Kang et al.
Patent Abstracts of Japan; Publication No. 2001-075526, dated Mar. 23, 2001 in the name of Makoto Onozawa et al.
Patent Abstracts of Japan; Publication No. 2001-318649, dated Nov. 16, 2001 in the name of Takashi Hashimoto et al.
Patent Abstracts of Japan; Publication No. 2002-014650, dated Jan. 18, 2002 in the name of Mitsuhiro Ishizuka.
Patent Abstracts of Japan; Publication No. 2002-062844, dated Feb. 28, 2002 in the name of Tomokatsu Kishi et al.
Patent Abstracts of Japan; Publication No. 2003-050563, dated Feb. 21, 2003 in the name of Katsutoshi Shindo et al.

* cited by examiner

METHOD AND CIRCUIT FOR DRIVING A PLASMA DISPLAY PANEL AND A PLASMA DISPLAY DEVICE

CROSS REFERENCE TO RELATED APPLICATION

This application claims priority to and the benefit of Korean Patent Application No. 10-2004-0037273 filed on May 25, 2004 in the Korean Intellectual Property Office, the entire content of which is incorporated herein by reference.

BACKGROUND OF THE INVENTION

1. Field of the Invention

The present invention relates to a driving method of a plasma display panel (PDP) and to the circuitry developed for generating and applying appropriate driving voltages.

2. Discussion of the Related Art

A plasma display device is a flat panel display that uses plasma generated by a gas discharge process to display characters or images. It includes a PDP with tens to millions of pixels provided in a matrix format, depending on the size of the PDP. A PDP may be classified as a DC PDP or an AC PDP, according to its discharge cell structure and the waveform of the driving voltage applied.

The DC PDP has electrodes exposed in a discharge space, allowing a current to flow in the discharge space while a voltage is supplied. The DC PDP, therefore, requires a resistor for limiting the current. On the other hand, the AC PDP electrodes are covered with a dielectric layer that forms a capacitor to limit the current and protects the electrodes from the impact of ions during discharge. Accordingly, the AC PDP has a longer lifespan than the DC PDP.

One frame of the PDP is defined as a period of time during which all of the pixels in the panel are addressed. One frame is divided into a plurality of subfields, and each subfield includes a reset period, an address period, and a sustain period. The reset period is for initializing the status of each discharge cell so as to facilitate an addressing operation on the discharge cell. The address period is for selecting turn-on/turn-off cells, that are the cells that must be turned on or turned off, and for accumulating wall charges on the turn-on cells that are addressed to be turned on. The sustain period is for causing the cells to either continue discharge for displaying an image on the addressed cells or remain inactive.

In order to perform the above operations and to display an image, sustain pulses are alternately applied to scan electrodes and sustain electrodes during the sustain period, and reset waveforms and scan waveforms are applied to the scan electrodes during the reset period and the address period. Therefore, a scan driving board for driving the scan electrodes and a sustain driving board for driving the sustain electrodes are separately needed. Mounting the two separate driving boards on a chassis base may generate problems and increase the overall cost of the device.

For combining the two driving boards into a single combined board, schemes of coupling the single combined board to the scan electrodes and extending the sustain electrodes to reach the combined board have been proposed. However, when the two driving boards are combined as such, the impedance component created at the extended sustain electrodes is increased.

SUMMARY OF THE INVENTION

The present invention provides a PDP having a combined board that can drive both scan electrodes and sustain electrodes. In addition, the present invention provides driving waveforms appropriate for such a combined board and circuits used to produce these driving waveforms.

According to an embodiment of the present invention, the sustain electrodes are biased at a constant voltage while driving waveforms are applied to the scan electrodes.

An exemplary method for driving a PDP is presented. The PDP includes scan electrodes, sustain electrodes, and address electrodes, arranged in a matrix form, the scan electrodes and the sustain electrodes forming parallel pairs and the address electrodes extending perpendicular to the scan electrodes and the sustain electrodes. The PDP is driven during frames, each frame having subfields, each subfield having a reset period followed by an address period followed by a sustain period, the reset period including a rising period and a falling period. The exemplary method includes biasing the sustain electrodes at a first voltage during all periods of each subfield; applying a negative second voltage to a non-selected electrode of the scan electrodes and a third voltage more negative than the second voltage to a selected electrode of the scan electrodes, during the address period; increasing the voltage of the scan electrodes from the negative second voltage to a positive fourth voltage at an end of the address period and a beginning of the sustain period; and alternately applying a negative fifth voltage and the positive fourth voltage to the scan electrodes, during the sustain period.

In a further embodiment a positive sixth voltage is applied to the scan electrodes after the negative fifth voltage is applied to the scan electrodes, at an end of the sustain period and a beginning of the reset period of a subsequent subfield; and the voltage of the scan electrodes is gradually increased from the positive sixth voltage to a seventh voltage during the rising period of the reset period of the subsequent subfield.

In another embodiment the voltage of the scan electrodes is decreased from the seventh voltage to a positive eighth voltage, at a beginning of the falling period of the reset period of the subsequent subfield; and the voltage of the scan electrodes is gradually decreased from the positive eighth voltage to a negative ninth voltage during the falling period of the reset period of the subsequent subfield.

A positive sixth voltage may be applied to the scan electrodes after the negative fifth voltage is applied to the scan electrode, at an end of the sustain period and a beginning of the reset period of a subsequent subfield; and the voltage of the scan electrodes may be gradually decreased from the positive sixth voltage to a negative seventh voltage during the reset period of the subsequent subfield.

The sixth positive voltage may be equal to the fourth positive voltage. The absolute value of the fourth positive voltage may be equal to the absolute value of the fifth negative voltage. The first voltage may be a ground voltage. An address pulse of a positive voltage may be applied to the sustain electrode during the address period. A constant voltage, above a bias voltage of the scan electrode, may be applied to the address electrode during at least a portion of the rising period of the reset period.

An exemplary plasma display device according to one embodiment of the present invention may include a PDP including scan electrodes, sustain electrodes, and address electrodes, arranged to form a matrix, the scan electrodes and the sustain electrodes forming parallel pairs and the address electrodes perpendicular to the scan electrodes and the sustain electrodes. The PDP may be driven during frames each frame having subfields, each subfield having a reset period followed by an address period followed by a sustain period, the reset period including a rising period and a falling period.

The plasma display device also includes a chassis base including a driving board applying a driving waveform, for displaying of an image on the plasma display panel, to the scan electrodes and the address electrodes and biasing the sustain electrodes at a first voltage during the displaying of the image.

The driving board may include a plurality of selecting circuits coupled with the scan electrodes so as to selectively apply a scan voltage a selected scan electrode and a non-scan voltage to a non-selected scan electrode; a first switch having a first terminal coupled to a first power source supplying the scan voltage and a second terminal coupled to the scan electrodes through the plurality of the selecting circuits; a second switch having a first terminal coupled to a second power source supplying a positive second voltage and a second terminal coupled to the scan electrodes through the plurality of the selecting circuits; and a third switch having a first terminal coupled to a third power source supplying a negative third voltage and a second terminal coupled to the scan electrodes through the plurality of the selecting circuits. During the address period, after the non-scan voltage is applied to the scan electrodes the first switch is turned off so that the non-scan voltage is no longer applied to the scan electrodes and the second switch is turned on so that the positive second voltage is applied to the scan electrodes, and during the sustain period, the second switch is turned off and the third switch is turned on so that the negative third voltage is applied to the scan electrodes, and the second switch and the third switch are turned on and off so that the positive second voltage and the negative third voltage are alternately applied to the scan electrodes.

Another embodiment of the plasma display device of this invention may also include a fourth switch having a first terminal coupled to a fourth power source for supplying a fourth voltage higher than the second voltage and a second terminal coupled to the scan electrodes through the plurality of selecting circuits, the fourth switch being operated such that the voltage of the scan electrodes is gradually increased from the positive second voltage to the fourth voltage. During the reset period of a subsequent subfield, the third switch is turned off and the second switch is turned on so as to apply the second voltage to the scan electrodes, and then the second switch is turned off and the fourth switch is turned on to apply the fourth voltage to the scan electrodes.

In a further embodiment of the plasma display device, the fourth switch may include a capacitor charged at the fourth voltage, the capacitor having a first plate coupled to the fourth power source and a second plate coupled with a connection node of the second switch and the third switch; and a transistor having a first terminal coupled to the first plate of the capacitor and a second terminal coupled to the scan electrodes through the plurality of the selecting circuits. During the sustain period, the third switch is turned on so as to apply the third voltage to the scan electrodes. During a first portion of the reset period, the third switch is turned off and the second switch is turned on so as to apply the positive second voltage to the scan electrodes, and subsequently, during the reset period, the fourth switch is turned on to apply the fourth voltage to the scan electrodes and to gradually increase a voltage of the scan electrodes from the positive second voltage to a sum of the positive second voltage and the fourth voltage.

In the plasma display device of this invention the fourth power source supplies power may be equal to a sum of the negative third voltage and the fourth voltage, and the capacitor may be charged to the fourth voltage by turning on of the third switch while the second switch and the fourth switch are off. The first voltage may be a ground voltage.

Another embodiment of the invention presents a scan driving circuit for generating driving waveforms for driving a panel capacitor formed by adjacent sustain and scan electrodes of a plasma display panel, where the sustain electrodes are grounded and the scan electrodes are coupled to the driving circuit and the scan driving circuit includes a sustain discharge portion for alternately supplying a positive sustain discharge voltage a negative sustain discharge voltage to the scan electrodes; a rising reset portion, coupled to the sustain discharge portion, for supplying a rising voltage ramp to the scan electrodes; a falling reset portion, coupled to the rising reset portion, for supplying a falling voltage ramp to the scan electrodes; and a scan driver portion, coupled to the falling reset portion, for applying a scan voltage to a selected scan electrode and a non-scan voltage to a non-selected scan electrode.

A further embodiment of the scan driving circuit may include a reference voltage supplier portion, coupled to the sustain discharge portion, and to the rising reset portion, for supplying a reference voltage. The scan driver portion may include a selecting circuit for selecting a selected scan electrode. The falling reset portion may include transistors operating to allow a small current to flow from their drains to their sources such that the voltage of the scan electrode may gradually decrease on turn-on of the transistors. The rising reset portion may include a first transistor operating to allow a small current to flow from a drain of the first transistor to a source of the first transistor such that the voltage of the scan electrode may gradually increase on turn-on of the one transistor. The rising reset portion may further include a capacitor with one plate coupled to the drain of the first transistor, the capacitor operating to gradually increase the voltage of the scan electrode while being charged; and a second transistor coupled between the first transistor and the capacitor, the second transistor operating as a switch between the falling reset portion and the sustain discharge portion.

DETAILED DESCRIPTION

Figure 1:
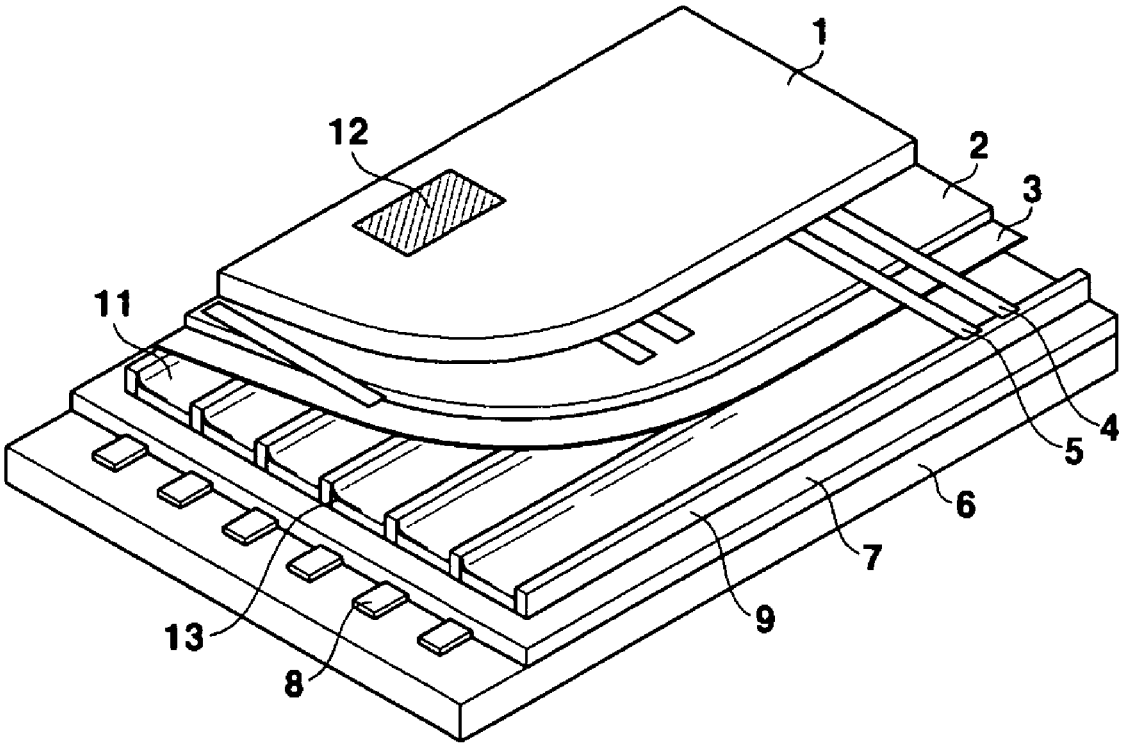
FIG. 1 shows a partial perspective view of a conventional AC PDP.

As shown in FIG. 1, a PDP includes a pair of substrates 1 and 6 disposed apart but facing each other. A plurality of scan (Y) electrodes 4 and sustain (X) electrodes 5 are formed in parallel pairs on the glass substrate 1. The scan electrodes 4 and the sustain electrodes 5 are covered with a dielectric layer 2 and a protective layer 3. A plurality of address (A) electrodes 8 are formed on the glass substrate 6, and are covered with an insulation layer 7. On the insulation layer 7, barrier ribs 9 are formed between two adjacent address electrodes 8. In addition, phosphor 13 is formed on a surface of the insulation layer 7 and on both sides of the barrier ribs 9. The glass substrates 1 and 6 are arranged facing each other interposing a discharge space such that the scan and sustain electrodes 4 and 5 lie perpendicular to the address electrodes 8. A discharge cell (hereinafter simply called a cell) 12 is formed at an intersection region of the address electrode 8 and a pair of scan and sustain electrodes 4, 5 by a discharge space 11.

Figure 2:
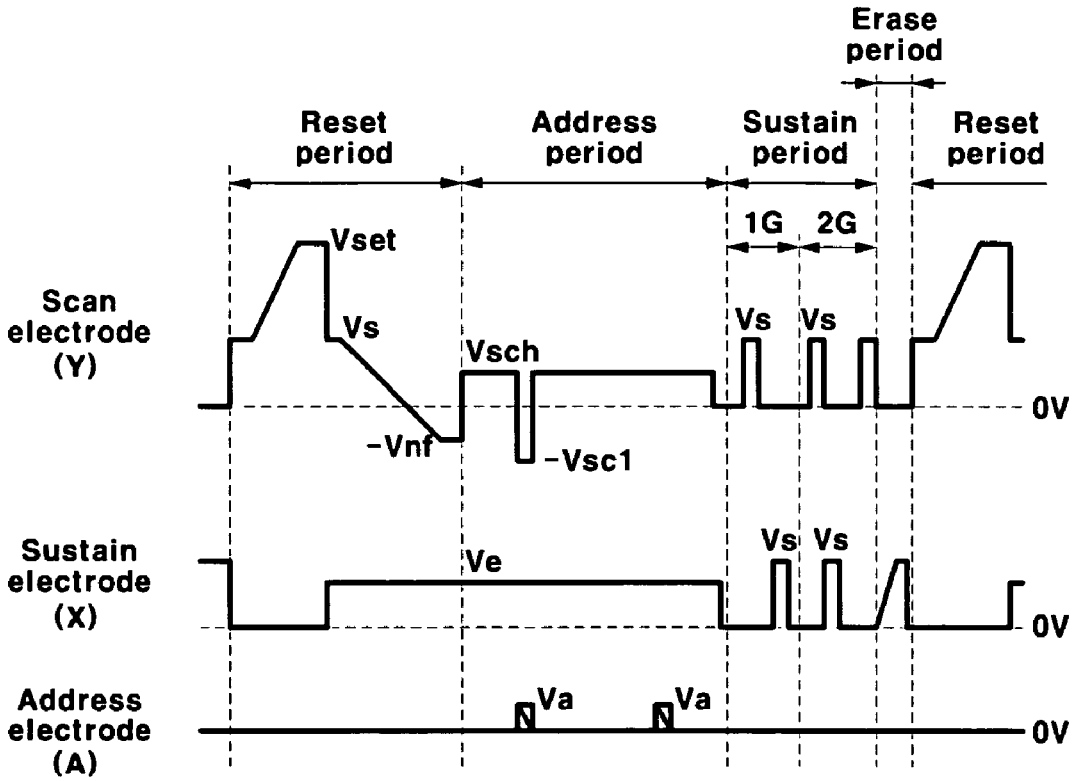
FIG.2 (Prior Art)
FIG. 2 shows exemplary driving waveforms of a conventional AC PDP.

FIG. 2 shows a conventional driving waveform of an AC PDP. Each subfield has a reset period, an address period, and a sustain period. The reset period is for eliminating wall charges formed by a previous sustain discharge and for initializing the state of each discharge cell so as to facilitate an addressing operation on the discharge cell. The address period, which is also called a scan period or a writing period, is for selecting the turn-on/turn-off cells in a panel and accumulating wall charges to the turn-on cells. The turn-on/turn-off cells are those to be turned on or off during the address period; the turn-on cells are those that are addressed during this period. The sustain period is for causing a discharge for displaying an image on the addressed cells.

In order to perform the above operations, sustain pulses are alternately applied to a scan electrode 4 and a sustain electrode 5, during the sustain period. A ramp voltage that gradually increases is applied to the sustain electrodes 5 during a subsequent erase period. In a subsequent reset period, a reset waveform is applied to the scan electrode 4 while an address electrode 8 is biased at a reference voltage and the sustain electrode 4 is biased at a constant voltage. In addition, during the address period for selecting the turn-on cells, an address waveform is applied to the address electrodes 8 while the scan and sustain electrodes 4, 5 remain at a predetermined voltage.

Wall charges mentioned in the following description mean charges formed and accumulated on a wall, namely the dielectric layer, close to an electrode of a discharge cell. The wall charge will be described as being "formed" or "accumulated" on the electrode, although the wall charges do not actually touch the electrodes. Further, a wall voltage means a potential difference created between the walls of the discharge cell by the wall charge formed on the walls.

Figure 3:
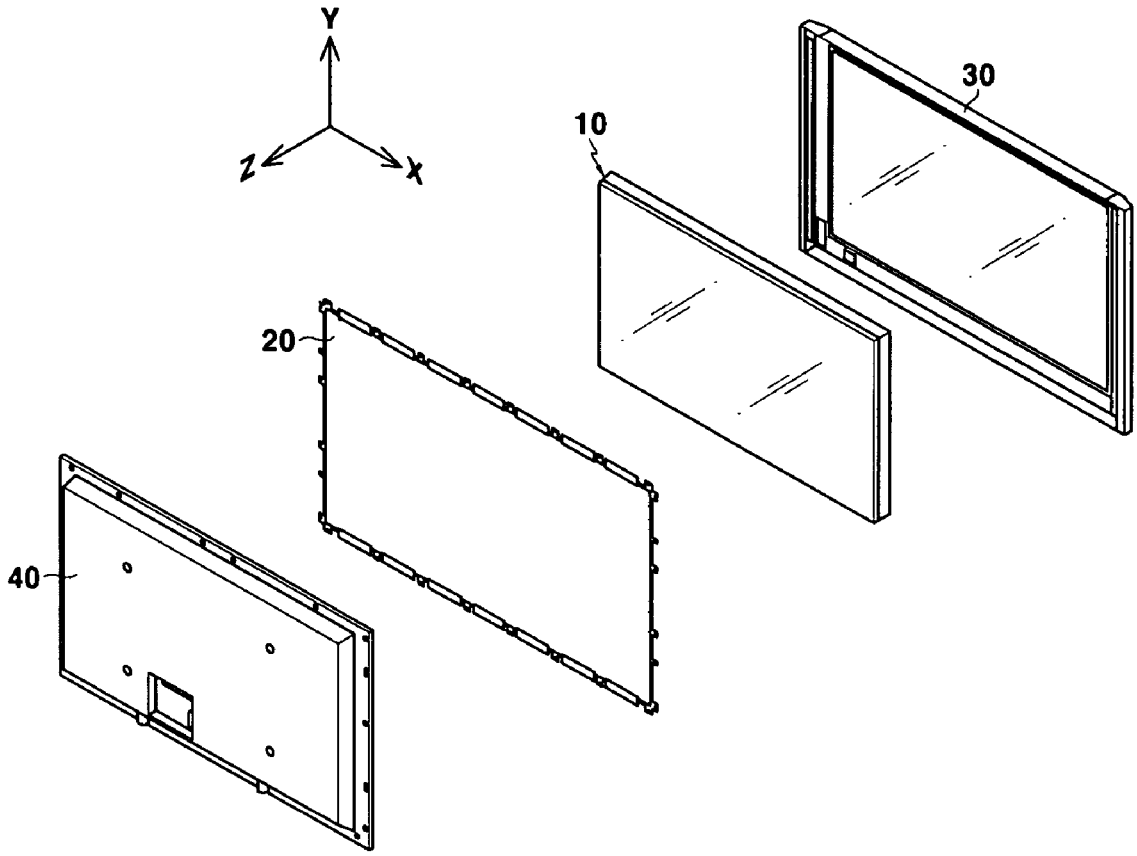
FIG. 3 shows an exploded perspective view of a PDP according to an exemplary embodiment of the present invention.
Figure 4:
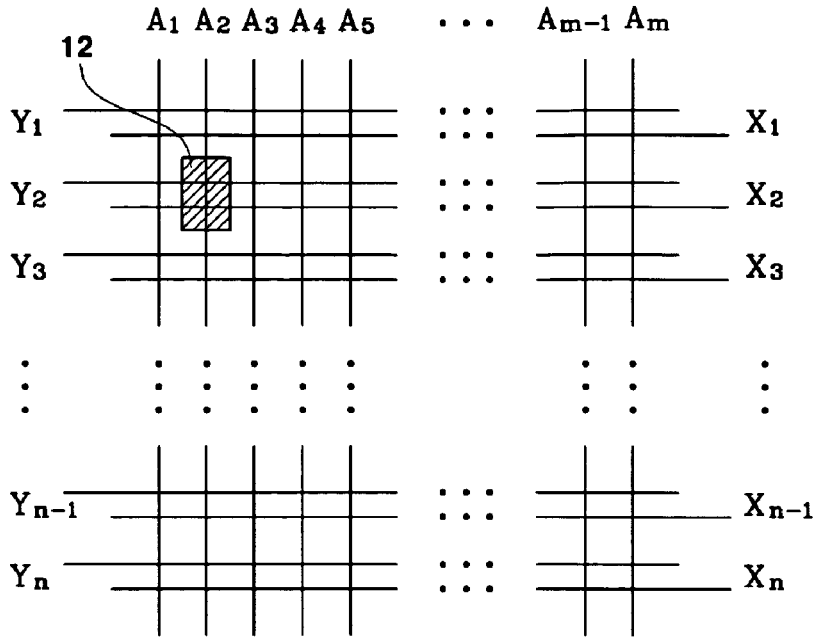
FIG. 4 shows a layout diagram of a PDP according to an exemplary embodiment of the present invention.
Figure 5:
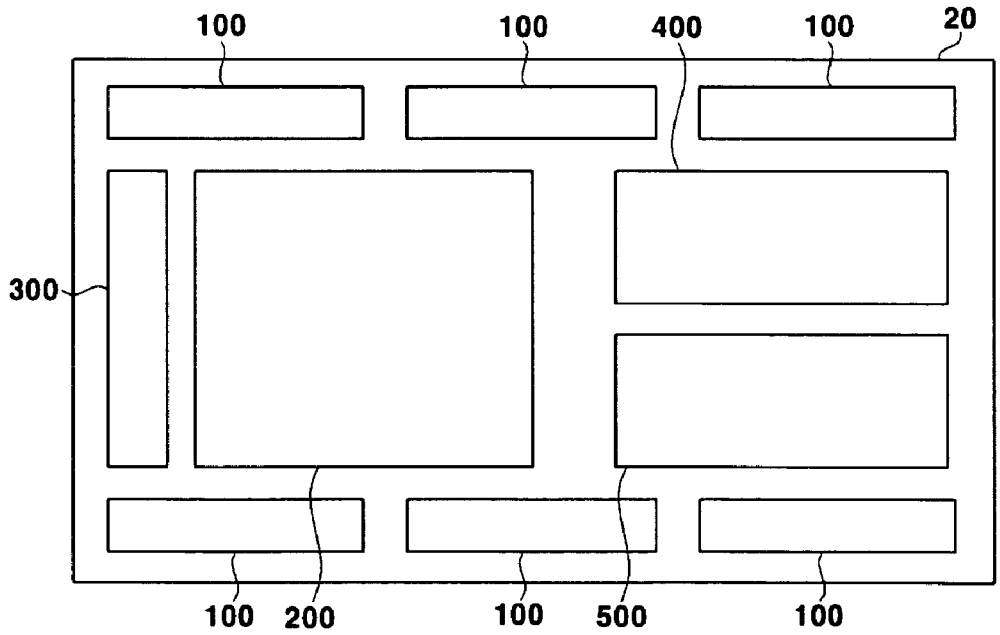
FIG. 5 shows a plan view of a chassis base according to an exemplary embodiment of the present invention.

FIG. 3 shows an exploded perspective view of a PDP according to an exemplary embodiment of the present invention. FIG. 4 shows a schematic layout diagram of a PDP according to an exemplary embodiment of the present invention. FIG. 5 shows a schematic plan view of a chassis base according to an exemplary embodiment of the present invention.

As shown in FIG. 3, a plasma display device includes a PDP 10, a chassis base 20, a front case 30, and a rear case 40. The chassis base 20 is coupled to the PDP 10 opposite the image display side of the PDP 10. The front and rear cases 30, 40 coupled to the front and the rear of the chassis base 20, respectively. The image display side of the PDP 10 is coupled to the front case 30 and the chassis base 20 is coupled to the rear case 40. All the parts together form the plasma display device.

As shown in FIG. 4, the PDP 10 includes a plurality of address electrodes $A_1$ to $A_m$ extending in a vertical direction, and a plurality of scan electrodes $Y_1$ to $Y_n$ and a plurality of sustain electrodes $X_1$ to $X_n$ each extending in a horizontal direction. The respective sustain electrodes $X_1$ to $X_n$ correspond to the respective scan electrodes $Y_1$ to $Y_n$.

The PDP 10 also includes an insulation substrate upon which the X and Y electrodes are formed, and another insulation substrate where the A electrodes are formed. The two insulation substrates are arranged to face each other with discharge spaces in between. The A electrodes cross the Y electrodes and the X electrodes and are perpendicular to both sets of Y and X electrodes. Discharge spaces are formed at a region where the A electrodes cross the X and Y electrodes, and such discharge spaces form cells 12.

As shown in FIG. 5, driving boards 100, 200, 300, 400, and 500 are formed on the chassis base 20 for driving the PDP 10. Address buffer boards 100, shown in upper and lower portions of the chassis base 20, may be formed as a single board or a plurality of boards. FIG. 4 illustrates a plasma display device driven by a dual driving method. In the case of a plasma display device driven by a single driving method, the address buffer board 100 is located at both the upper and lower ends of the chassis base 20. Such an address buffer board 100 receives an address driving control signal from an image processing and controlling board 400, and applies a voltage for selecting the turn-on discharge cells 12 to the A electrodes.

A scan driving board 200 is located to the left on the chassis base 20, and is coupled with the Y electrodes through a scan buffer board 300. The scan driving board 200 receives driving signals from the image processing and controlling board 400, and applies the driving voltage to the Y electrodes. The X electrodes are biased at a constant voltage.

The scan buffer board 300 applies a voltage to the Y electrodes for sequential selection of these electrodes during an address period. In FIG. 5, the scan driving board 200 and the scan buffer board 300 are shown to be located to the left on the chassis base 20. These driving boards, however, may be located to the right of this board. In addition, the scan buffer board 300 and the scan driving board 200 may be formed together as one part.

The image processing and controlling board 400, receiving image signals, generates control signals for driving the A electrodes and control signals for driving the Y and X electrodes, and applies the received signals to the address driving board 100 and the scan driving board 200. A power supply board 500 supplies electric power for driving the plasma display device. The image processing and controlling board 400 and the power board 500 may be located in a central area of the chassis base 20.

Figure 6:
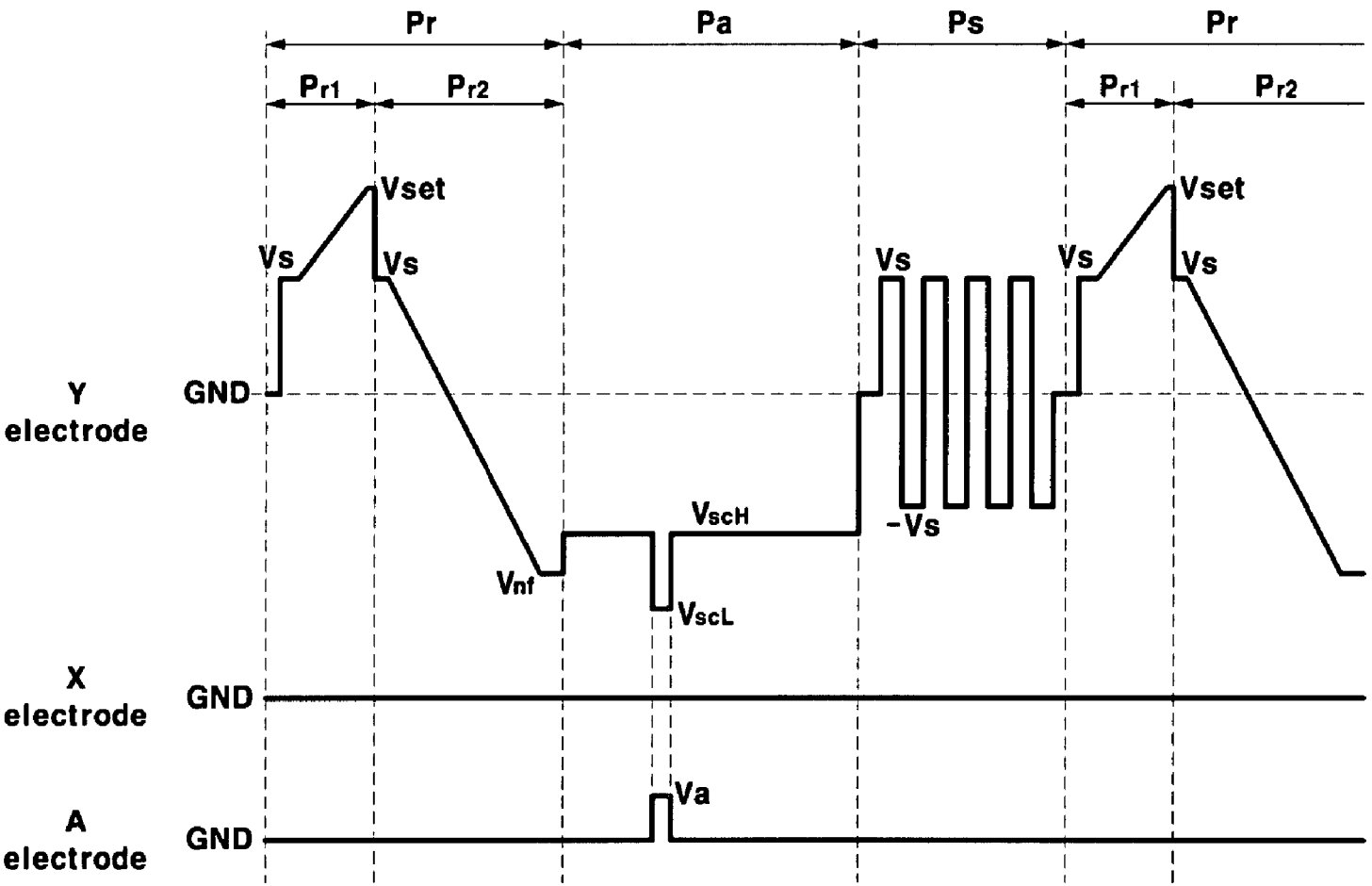
FIG. 6 shows driving waveforms according to a first exemplary embodiment of the present invention.

FIG. 6 shows a driving waveform of a PDP according to a first embodiment of the present invention. In the following written description, the driving waveforms applied to a Y electrode, a X electrode, and an A electrode are described in connection with only one cell, for better comprehension and convenience of description. In addition, in the driving waveform shown in FIG. 6, the voltage applied to the Y electrode is supplied from the scan driving board 200 and the scan buffer board 300, and the voltage applied to the A electrode is supplied from the address buffer board 100. Because the X electrode is biased at a constant reference voltage, which is the ground voltage in the example shown in FIG. 6, the voltage applied to the X electrode is not described in further detail.

As shown in FIG. 6, a subfield includes a reset period Pr, an address period Pa, and a sustain period Ps, and the reset period Pr includes a rising period Pr1 and a falling period Pr2. The rising period Pr1 is for forming wall charges on the scan, sustain and address electrodes Y, X, A while the falling period Pr2 is for partially erasing the wall charges formed in the rising period Pr1 thereby facilitating address discharges. The address period Pa is for selecting discharge cells where a sustain discharge will be generated during sustain period Ps. The sustain period Ps is for applying sustain discharge pulses to a Y electrode and a X electrode in order to generate the sustain discharge in the selected discharge cells.

The PDP is coupled with scan/sustain driving circuits for applying driving voltages to the Y and X electrodes during the reset, address, and sustain periods Pr, Pa, Ps. The PDP is coupled with an address driving circuit for applying a driving voltage to the A electrode.

During the rising period Pr1 of the reset period Pr, a ramp voltage which is gradually rising from Vs to Vset is applied to the Y electrode while the A and X electrodes are maintained at the reference voltage (0V in FIG. 6). While the voltage of the Y electrode increases, a weak discharge occurs between the Y and X electrodes and between the Y and A electrodes. Accordingly, negative (−) wall charges are formed on the Y electrode, and positive (+) wall charges are formed on the X and A electrodes. When the voltage of the scan electrode Y gradually changes as shown in FIG. 6, a weak discharge occurring in a cell forms wall charges such that a sum of an externally applied voltage and the wall charge may be maintained at a discharge firing voltage.

The voltage Vset is a voltage high enough to fire a discharge in cells of any condition because every cell has to be initialized during the reset period. In addition, the voltage Vs equals the voltage applied to the Y electrode in the sustain period Ps and is lower than a firing discharge voltage between the Y and X electrodes.

During the falling period Pr2, the voltage of the Y electrode is gradually decreased from the voltage Vs to a voltage Vnf while maintaining the A electrode at the reference voltage. While the voltage of the Y electrode decreases, a weak discharge occurs between the Y and X electrodes and between the Y and A electrodes. Accordingly, the negative (−) wall charges formed on the Y electrode and the positive (+) wall charges formed on the X and A electrodes are eliminated. The voltage Vnf is usually set close to a discharge firing voltage between the Y and X electrodes. Then, the wall voltage between the Y and X electrodes becomes near 0V, and accordingly, a discharge cell that has not experienced an address discharge in the address period may be prevented from misfiring in the sustain period. In addition, the wall voltage between the Y and A electrodes is determined by the level of the voltage Vnf, because the A electrode is maintained at the reference voltage.

Subsequently, during the address period for selection of turn-on cells, a scan pulse of a negative voltage VscL and an address pulse of a positive voltage Va are applied to Y and A electrodes of the turn-on cells, respectively. Non-selected Y electrodes are biased at a voltage VscH that is higher than the voltage VscL, and the reference voltage is applied to the A electrode of the turn-off cells that are the cells to be turned off. For such an operation, the scan buffer board 300 selects a Y electrode to be applied with the scan pulse VscL, among the scan electrodes $Y_1$ to $Y_n$. For example, in a single driving method, the Y electrode may be selected according to an order of arrangement of the Y electrodes in the vertical direction. When a Y electrode is selected, the address buffer board 100 selects turn-on cells among cells formed on the selected Y electrode. That is, the address buffer board 100 selects A electrodes to which the address pulse of the voltage of Va is applied among the address electrodes $A_1$ to $A_m$.

In more detail, the scan pulse of the voltage VscL is first applied to $Y_1$, the scan electrode of the first row, and at the same time, the address pulse of the voltage Va is applied to an A electrode on a turn-on cell in the first row. Then a discharge is generated between the Y electrode of the first row ($Y_1$) and the A electrode applied with the voltage Va, and accordingly, positive (+) wall charges are formed on the Y electrode and negative (−) wall charges are formed on the A and X electrodes. As a result, a wall voltage Vwxy is formed between the X and Y electrodes such that the potential of the Y electrode becomes higher than the same of the X electrode. Subsequently, the address pulse of the voltage Va is applied to the A electrodes of turn-on cells in a second row while the scan voltage of the voltage VscL is applied to Y2, the Y electrode in the second row. Then, the address discharge is generated in the cells crossed by the A electrodes, receiving the voltage Va, and the Y electrode in the second row, and accordingly, wall charges are formed in the corresponding cells, in the manner described above. Regarding Y electrodes in other rows, wall charges are formed in turn-on cells in the same manner described above, i.e., by applying the address pulse Va to A electrodes on turn-on cells while sequentially applying a scan pulse VscL to the Y electrodes.

In such an address period Pa, the voltage VscL is usually set equal to or lower than the voltage Vnf, and the voltage Va is usually set greater than the reference voltage. Generation of the address discharge by applying the voltage Va to the A electrode is described in connection with the case that VscL equals Vnf. When the voltage Vnf is applied during the reset period, a sum of the wall voltage between the A and Y electrodes and the external voltage Vnf between the A and Y electrodes reaches the discharge firing voltage, Vfay, between the A and Y electrodes. When the A electrode is applied with 0V and the Y electrode is applied with the voltage VscL (=Vnf) in the address period Pa, the voltage Vfay is formed between the A and Y electrodes, and accordingly generation of a discharge may be expected. However, in this case, the discharge is not generated because a discharge delay is greater than the width of the scan pulse and the address pulse. However, if the voltage Va is applied to the A electrode while the voltage VscL(=Vnf) is applied to the Y electrode, a voltage greater than the voltage Vfay is formed between the A and Y electrodes such that the discharge delay is reduced to less than the width of the scan pulse. In this case, the discharge may be generated. At this time, generation of the address discharge may be facilitated by setting the voltage VscL to be less than the voltage Vnf.

Subsequently, during the sustain period Ps, a sustain discharge is triggered between the Y and X electrodes by initially applying a pulse of the voltage Vs to the Y electrode. In the cells that have experienced an address discharge during the address period Pa, the wall voltage Vwxy is formed such that the potential of the Y electrode is higher than the same of the X electrode. In this case, the voltage Vs is set such that it is lower than the discharge firing voltage Vfxy and a voltage value Vs+Vwxy is higher than the voltage Vfxy. As a result of such a sustain discharge, negative (−) wall charges are formed on the Y electrode and positive (+) wall charges are formed on the X and A electrodes, such that the potential of the X electrode is higher than the same of the Y electrode.

Now, since the wall voltage Vwxy is formed such that the potential of the Y electrode becomes higher than the X electrode, a pulse of a negative voltage −Vs is applied to the Y electrode to fire a subsequent sustain discharge. Therefore, positive (+) wall charges are formed on the Y electrode and negative (−) wall charges are formed on the X and A electrodes, such that another sustain discharge may be fired by applying the voltage Vs to the Y electrode. Subsequently, the process of alternately applying the sustain pulses of voltages Vs and −Vs to the Y electrode is repeated by the number corresponding to a weight value of a corresponding subfield.

As described above, according to the first embodiment of the present invention, reset, address, and sustain operations may be performed by a driving waveform applied only to the Y electrode while the X electrode is biased at a constant voltage. Therefore, a driving board for driving the X electrode is not required, and the X electrode may be simply biased at the reference voltage.

As shown in FIG. 6, according to the first exemplary embodiment, a final voltage applied to the Y electrode in the falling period Pr2 of the reset period is set to be the voltage Vnf, and the final voltage Vnf may be near the discharge firing voltage between the Y and X electrodes. However, at the final voltage Vnf of the falling period, a wall potential of the Y electrode with respect to the A electrode may be set to be a positive voltage because the discharge firing voltage Vfay between the scan and address electrodes Y, A is generally less than the discharge firing voltage Vfxy between the Y and X electrodes. A reset period of a subsequent subfield begins while the above wall charge state is maintained in the cells, because the sustain discharge is not generated in cells that have not undergone an address discharge. In the above cell state, the wall potential of the Y electrode with respect to the X electrode is greater than the wall potential of the Y electrode with respect to the A electrode. Therefore, when the voltage of the Y electrode is increased during the rising period Pr1 of the reset period Pr, the voltage between the X and Y electrodes may exceed the discharge firing voltage a while after the voltage between the A and Y electrodes has exceeded the discharge firing voltage Vfay.

In the rising period Pr1 of the reset period Pr, the Y electrode operates as a positive electrode and the A and X electrodes operate as negative electrodes because a high voltage is applied to the Y electrode. The discharge in the cell is determined by the amount of secondary electrons emitted from the negative electrode when positive ions collide against the negative electrode in a process referred to as a "γ process." In a PDP, the X and Y electrodes are typically covered with a material of a high secondary electron emission coefficient for increasing sustain-discharge performance, while the A electrode is covered with a phosphor for color representation. An MgO film may be used for such a material of a high secondary electron emission coefficient. However, during the rising period, the discharge may be delayed between the A and Y electrodes because the A electrode covered with the phosphor operates as the negative electrode when the voltage between the A and Y electrodes exceeds the discharge firing voltage Vfay. Due to the discharge delay, the voltage between the A and Y electrodes is greater than the discharge firing voltage at the time that the discharge is practically generated between the A and Y electrodes. Accordingly, a strong discharge rather than a weak discharge may be generated between the A and Y electrodes by the high voltage caused by the discharge delay. Another strong discharge may be generated between the sustain and address electrodes X, A by the strong discharge between the A and Y electrodes. Therefore, more positive wall charges are formed in the cells than the positive wall charges resulting from a normal rising period Pr1, and a greater number of priming particles are generated.

Accordingly, a strong discharge may be generated during the falling period Pr2 by the wall charges and the priming particles, and the wall charges may not be properly eliminated between the X and Y electrodes. In this case, when the reset period ends, a high wall voltage is formed between the X and Y electrodes in the cell. Therefore, misfiring may be generated between the X and Y electrodes by the high wall voltage during the sustain period. An exemplary embodiment for preventing this misfiring discharge will be described with reference to FIG. 7.

Figure 7:
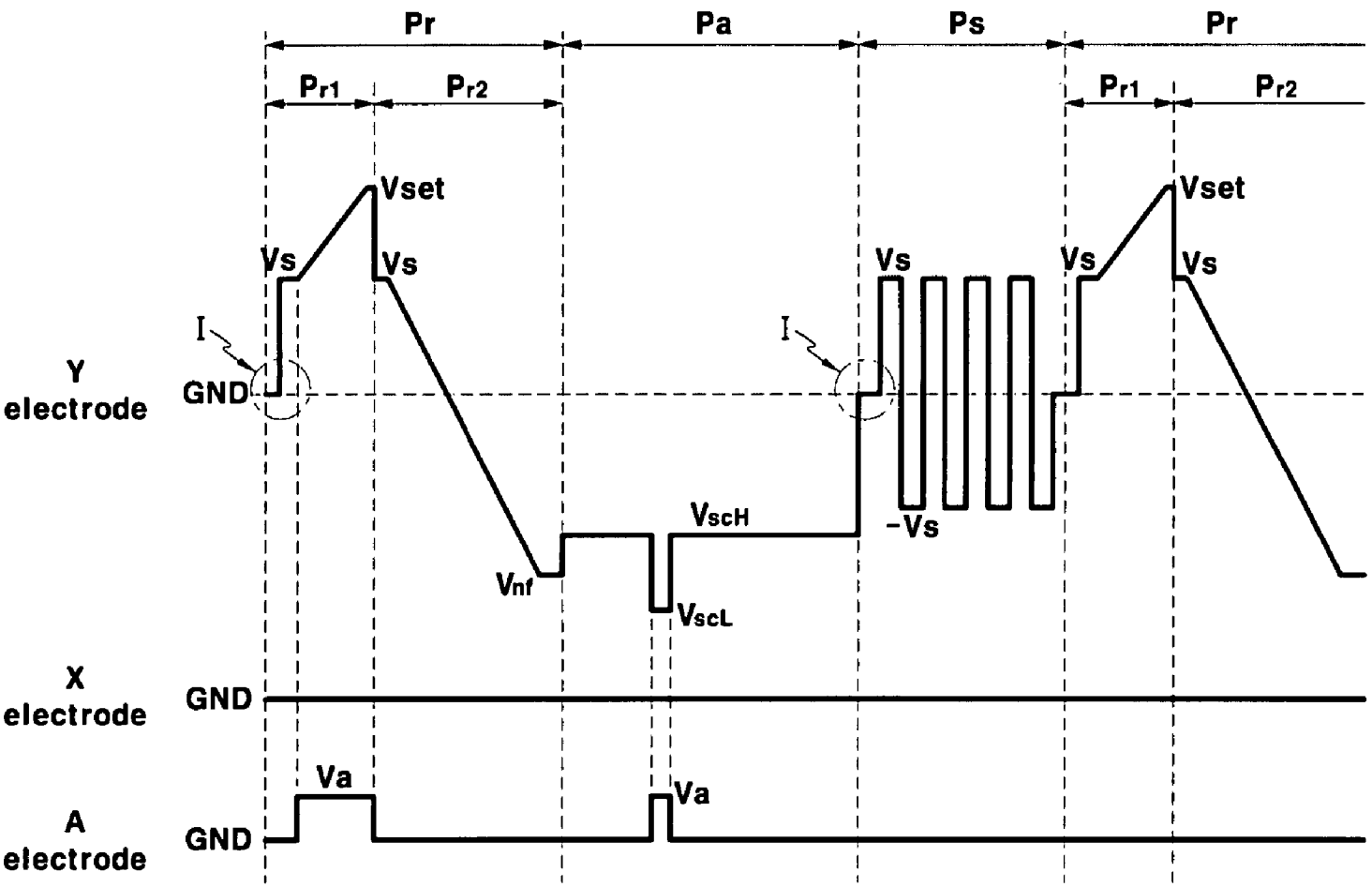
FIG. 7 shows driving waveforms according to a second exemplary embodiment of the present invention.

FIG. 7 shows driving waveforms according to a second exemplary embodiment of the present invention. While the driving waveform according to the second exemplary embodiment of the present invention is similar to the waveform of the first embodiment, the A electrode is biased at a constant voltage, higher than the reference voltage, during the rising period Pr1 of the reset period Pr, in the second embodiment.

In more detail, the voltage of the Y electrode is gradually increased from the voltage Vs to the voltage Vset while the A electrode is biased at a constant voltage, which is higher than the reference voltage, during the rising period Pr1 of the reset period. Accordingly, it is not necessary to form an additional voltage to apply the bias voltage to the A electrode if a voltage Va is used as the bias voltage of the A electrode. When the voltage of the Y electrode is increased while the A electrode is biased at the voltage Va, the voltage between the A and Y electrodes is less than the voltage between these two electrodes in the first exemplary embodiment. Therefore the voltage between the X and Y electrodes exceeds the discharge firing voltage before the voltage between the A and Y electrodes exceeds the discharge firing voltage. Then a weak discharge is generated between the X and Y electrodes thereby forming priming particles, and the voltage between the A and Y electrodes exceeds a discharge firing voltage in such a state. The discharge delay is reduced between the A and Y electrodes by the priming particles. Accordingly, a weak discharge instead of a strong discharge is generated between the A and Y electrodes, and wall charges are properly formed. Misfiring may also be prevented during the falling period Pr2 of the reset period Pr because strong discharge is not generated.

Figure 8:
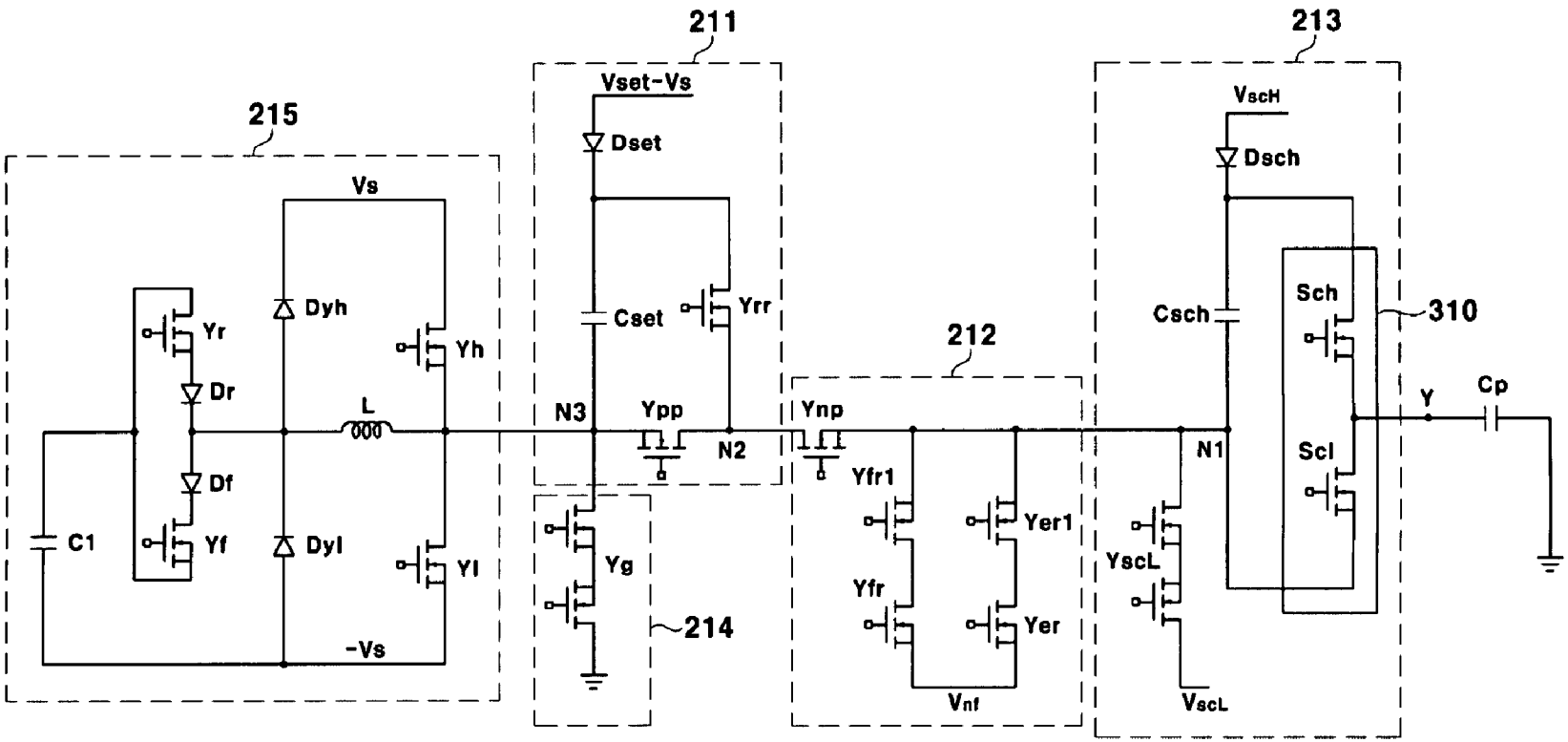
FIG. 8 shows a driving circuit for generating the driving waveforms of FIG. 7.

FIG. 8 shows a driving circuit for generating the driving waveforms of FIG. 7. Each transistor may have an anode coupled with the source, and a cathode coupled with the drain to form a body diode. A scan driving board 200 includes a rising reset portion 211, a falling reset portion 212, a scan driver portion 213, a sustain discharge portion 214, and a reference voltage supplier portion 215. For better comprehension and convenience of description, FIG. 8 shows only one Y electrode and only one selecting circuit. A capacitive component formed by adjacent X and Y electrodes is denoted by a panel capacitor Cp. The X electrode of the panel capacitor Cp is biased at the ground voltage as an example.

The rising reset portion 211 includes a diode Dset, a capacitor Cset and transistors Ypp and Yrr, and applies the ramp voltage rising from the Vs to the Vset to the Y electrode. The capacitor Cset is coupled between a source of the negative transistor Ypp and a drain of the transistor Yrr. A drain of the transistor Ypp and a source of the transistor Yrr are coupled to a second node N2. In this case, the capacitor Cset is charged by a voltage Vset-Vs when a transistor Yg is turned on. The transistor Yrr, when turned on, operates to allow a small current to flow from its drain to its source such that the panel capacitor Cp is gradually charged to the voltage Vset in a ramp pattern.

The diode Dset is coupled between the power source of a voltage Vset-Vs and a node where the drain of the transistor Yrr contacts the capacitor Cset, and intercepts the current path of the capacitor Cset—the diode Dset—the power source of the voltage Vset-Vs.

The falling reset portion 212 includes transistors Ynp, Yfr, and Yer, and applies a ramp voltage falling from the Vs to the Vnf to the capacitor Cp. Drains of the transistors Yer and Yfr are coupled at a first node N1, and sources of the transistors Yer and Yfr are coupled at a power source of the voltage Vnf. The transistors Yer and Yfr operate to allow a small current to flow from their drains to their sources such that the voltage of the Y electrode may gradually decrease on turn-on of these two transistors. At this time, the transistor Ynp shuts off the current path of the GND—the transistor Yg—the transistor Ypp—the transistor Ynp—the transistor Yfr, which may be formed when the voltage Vnf is negative.

The scan driver portion 213 includes a selecting circuit 310, a diode Dsch, a capacitor Csch, and a transistor YscL, and sequentially supplies the scan voltage VscL to the Y electrode. Generally, in order that a plurality of scan electrodes $Y_1$ to $Y_n$ may be sequentially selected during the address period, each of the scan electrodes $Y_1$ to $Y_n$ is coupled with the selecting circuit 310 formed as an IC. The driving circuit of the scan driving board 200 is coupled with the scan electrodes $Y_1$ to $Y_n$ through the selecting circuit 310.

The selecting circuit 310 includes transistors Sch and Scl, the source of the transistor Sch and the drain of the transistor Scl are coupled to the Y electrode of the panel capacitor Cp, and the source of the transistor Scl is coupled to the first node N1.

The capacitor Csch is coupled between the drain of the transistor Sch and the first node N1. the diode Dsch is coupled between a power source of a non-scan voltage Vsch and the node where the capacitor Csch and the drain of the transistor Sch are interconnected. The capacitor Csch is charged by the voltage Vsch-VscL when the transistor YscL is turned on. A first node of the capacitor Csch is coupled to the drain of the transistor Sch, and the second node of the capacitor is coupled to the first node N1. The transistor YscL is coupled between the first node N1 and the power source of the scan voltage VscL, and supplies the voltage VscL to the Y electrode of a discharge cell to be selected.

During the address period Pa, the transistor Sch is turned on to apply the non-scan voltage VscH to non-selected Y electrodes while the transistor Scd is turned on to apply the scan voltage VscL to selected Y electrodes.

The reference voltage supplier portion 214 includes a transistor Yg. The transistor Yg is coupled between a third node N3 and a voltage source of a ground voltage 0V, and supplies the ground voltage to the Y electrode.

The sustain discharge portion 215 includes a inductor L, transistors Yh, Yl, Yr, and Yf, diodes Dr and Df, and a capacitor C1, and supplies the voltage Vs or the voltage −Vs to the Y electrodes during the sustain period Ps.

The transistor Yh has a drain coupled with a power source of the voltage Vs and a source coupled with the third node N3, while the transistor Yl has a drain coupled with the third node N3 and a source coupled with a power source of the voltage −Vs. The inductor L has a first terminal coupled with the third node and a second terminal coupled with a source of the transistor Yr. The capacitor C1 has a first terminal coupled with a drain of the transistor Yr. In order to shut off the current that may be formed by body diodes of the transistors Yr and Yf, diodes Dr and Df are arranged in a direction inverse to the body diode of the transistors Yr and Yf. A second node of the capacitor C1 is coupled with the power source of −Vs, and is charged at a voltage amounting to the voltage Vs. Also, diodes Dyh and Dyl may be respectively formed between the power source of −Vs and a second terminal of the inductor L and between the power source of Vs and a second terminal of the inductor L, so as to clamp an electric potential of the inductor L.

Because the voltage VscL is lower than the voltage Vnf in waveforms of FIG. 7, the current path may be formed through the body diodes of the transistors Yfr and Yer when the transistor YscL is turned on. In order to shut off this current path, transistors Yfr1 and Yer1 may further be formed as shown in FIG. 6, which have their body diode in a direction reverse to the transistor Yfr and Yer. Also, diodes may be used instead of such transistors Yfr1 and Yer1. Similarly, transistors Yg in the reference voltage supplier 214 and YscL in the scan driver portion 213, may be replaced by a series connection of two transistors as shown. One of the transistors of each pair serves as a diode with respect to the other transistor and opposes the current flowing through the body diode of this other transistor. An actual diode may be used in place of the second transistor.

As described above, according to the first and second embodiments of the present invention, reset, address, and sustain operations may be performed by a driving waveform applied only to the Y electrode while the X electrode is biased at the reference voltage. Accordingly, a driving board for driving the X electrode is not required and the X electrode may be simply biased at the reference voltage.

Referring back to FIG. 7, during the rising period Pr1, of the reset period Pr or during the sustain period Ps, the ground voltage is applied to the Y electrode. At this time, the driving circuit allows the switching element Yg to be turned on so that the ground voltage is supplied to the Y electrode. However, it is notable that the voltage of the Y electrode may not be biased at the ground voltage during the rising period Pr1 of the reset period Pr or during the sustain period Ps. When the voltage of the Y electrode is not biased at the ground voltage, the switching element for supplying the ground voltage is not required thereby having an effect of reducing manufacturing cost of the circuit. Such an embodiment will hereinafter be described in detail with reference to FIGS. 9 and 10.

Figure 9:
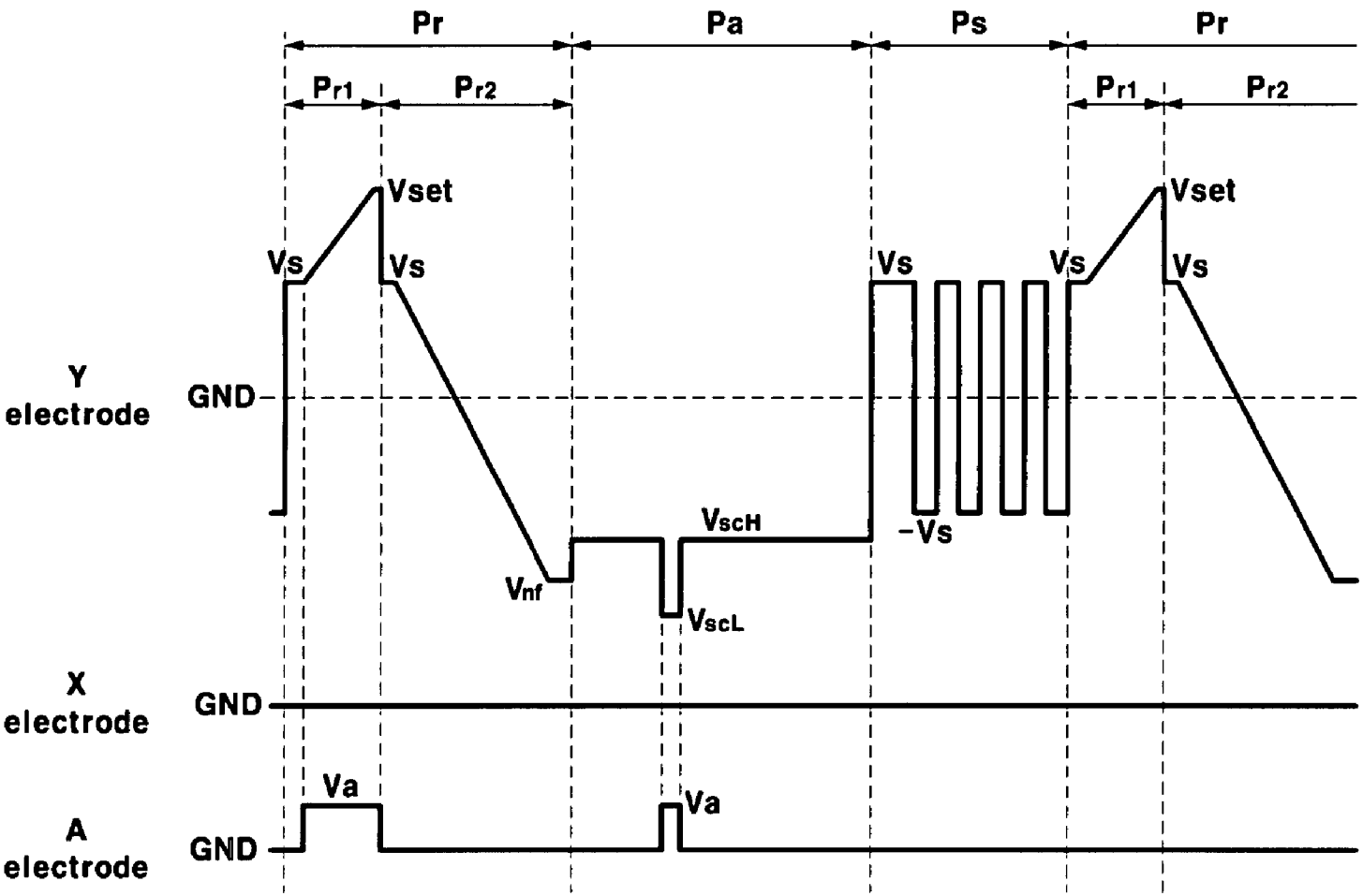
FIG. 9 shows driving waveforms according to a third exemplary embodiment of the present invention.
Figure 10:
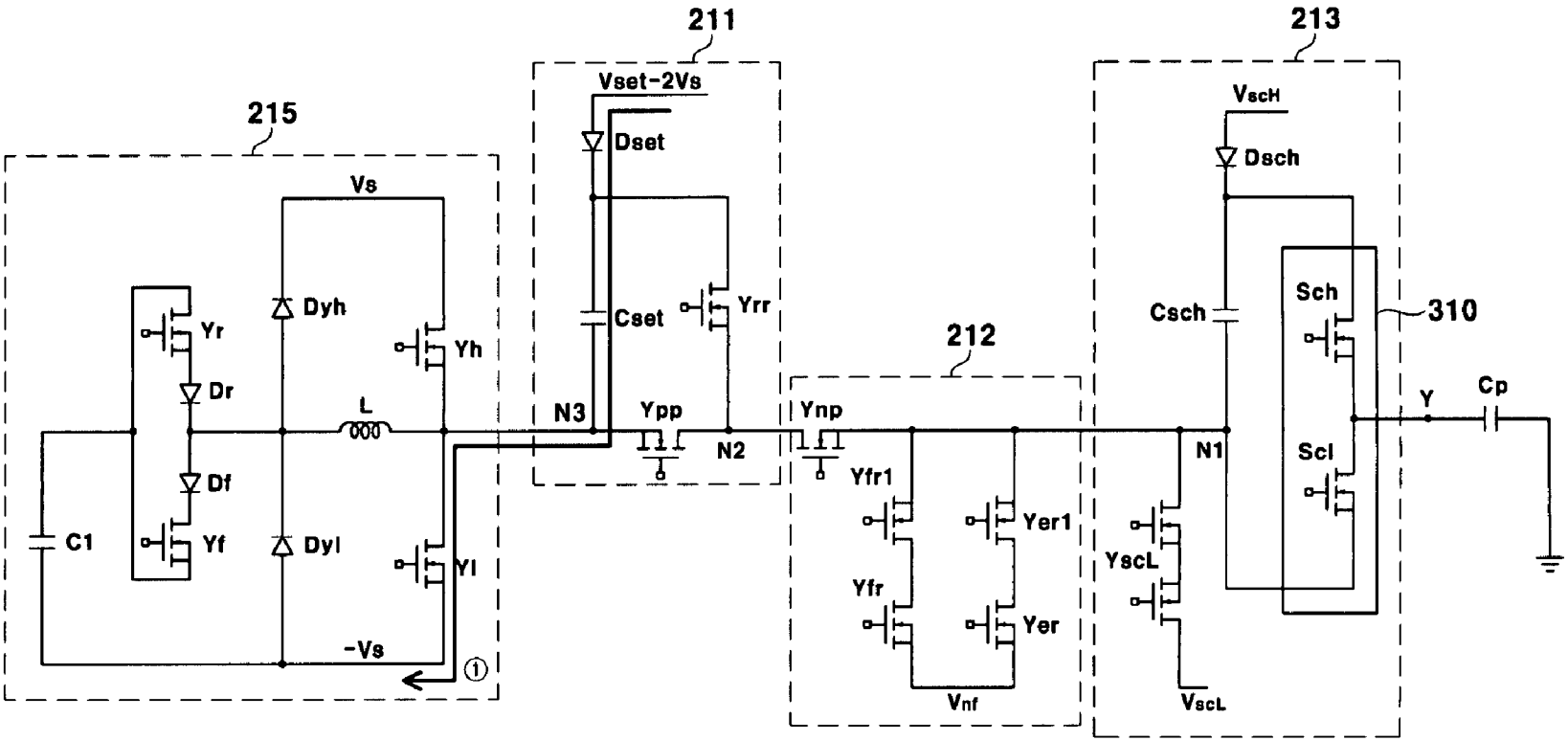
FIG. 10 shows a driving circuit for generating the driving waveforms of FIG. 9.

FIG. 9 shows driving waveforms according to a third exemplary embodiment of the present invention, and FIG. 10 shows a driving circuit for generating the driving waveforms of FIG. 9.

As shown in FIG. 9, the driving waveform according to the third embodiment is similar to the first embodiment. However, according to the present embodiment, the voltage of the Y electrode is increased to the voltage Vs immediately after an end of the address period Pa at which the voltage VscH is applied to the Y electrode, and also immediately after an end of the sustain period Ps at which the voltage −Vs is applied to the Y electrode.

In more detail, during the sustain period Ps, the voltage of the Y electrode is immediately increased from the voltage VscH to the voltage Vs and then a sustain discharge pulse oscillating between the voltages Vs and −Vs is applied to the Y electrode. During the reset period Pr, the voltage of the Y electrode is immediately increased from the voltage −Vs of the sustain period Ps to the voltage Vs, and then gradually increased from the voltage Vs to the voltage Vset.

On the other hand, the driving circuit shown in FIG. 10 for creating the waveform of FIG. 9 is similar to the driving circuit of FIG. 8 for creating the waveform of FIG. 7. However, in the circuit of FIG. 10 the capacitor Cset is charged at Vset through the path ① while the transistor Yg for supplying the ground voltage is removed. In addition, both terminals of the capacitor Cset are coupled with the power source of a voltage Vset-2Vs.

In the driving circuit of FIG. 8, the capacitor Cset is charged at the Vset-Vs voltage when the transistor Yg is turned on. However, in the driving circuit of FIG. 10, the transistor Yg is removed and the capacitor Cset is charged at the voltage Vset from the power source of −Vs when the transistor Yl is turned on (refer to the path ①). With this scheme, the driving waveform of the third embodiment of FIG. 9 may be achieved without the transistor Yg.

Figure 11A:
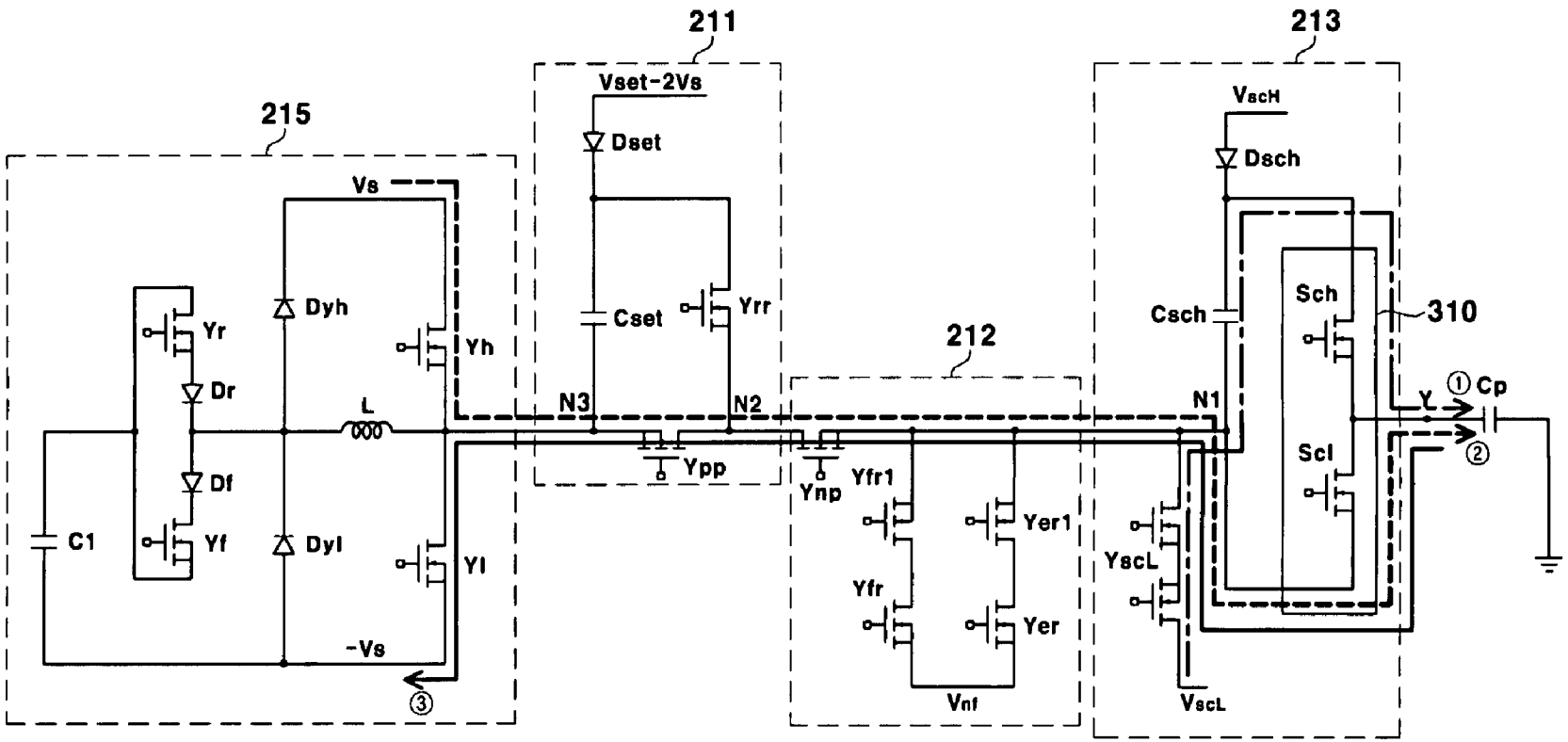
FIGS. 11A and 11B show current paths for generating driving waveforms during the sustain period in the driving circuit of FIG. 10.
Figure 11B:
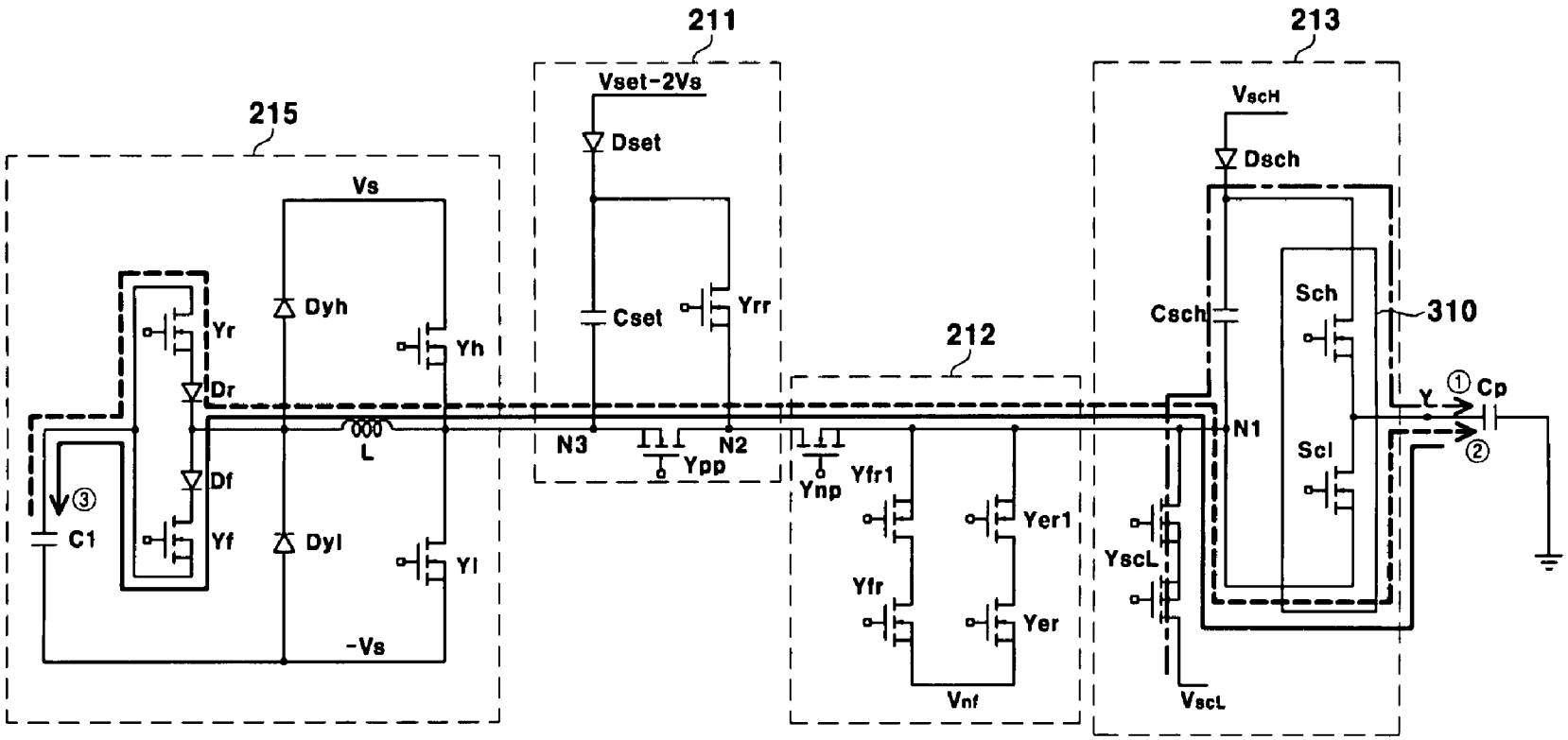
Figure 12A:
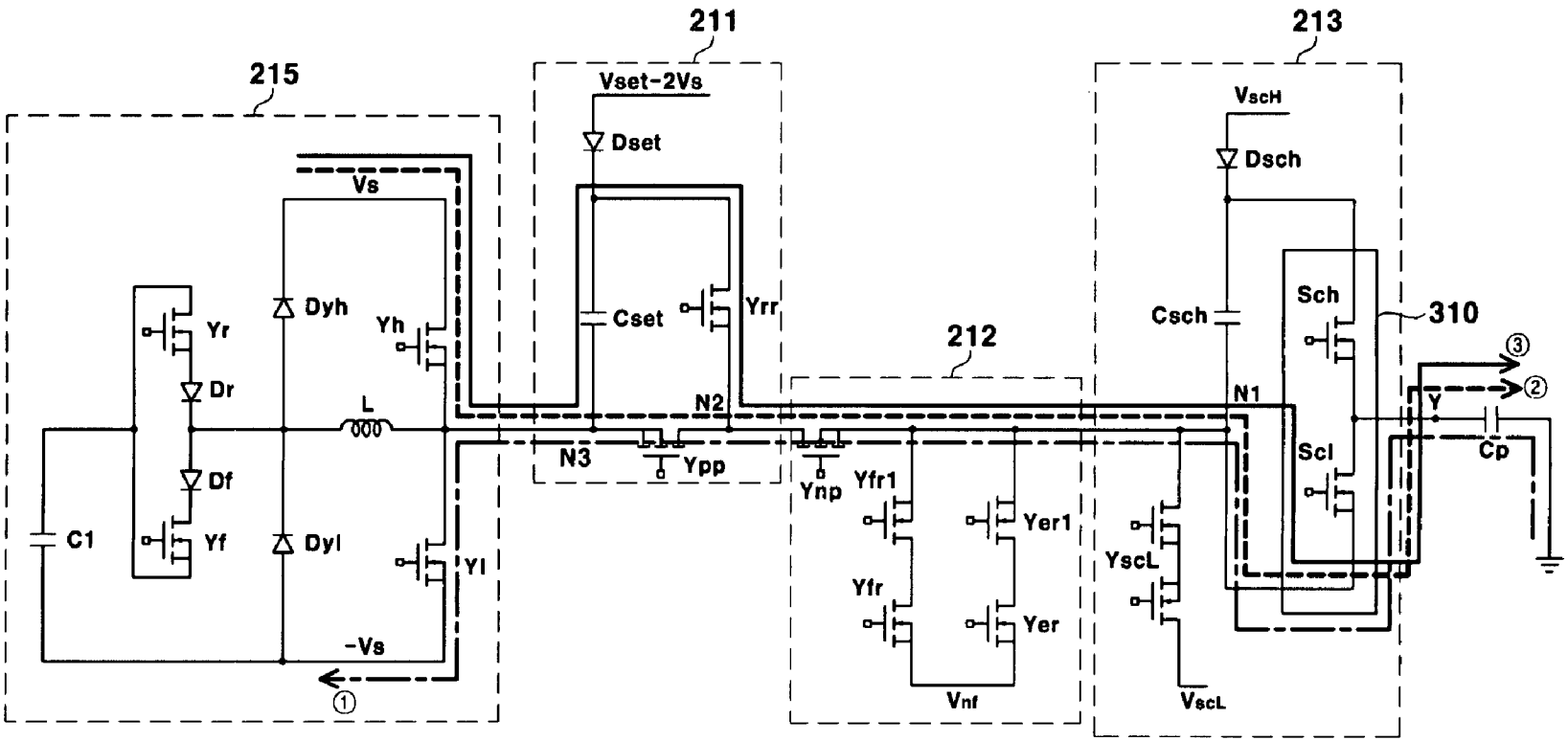
FIGS. 12A and 12B show current paths for generating driving waveforms during the reset period in the driving circuit of FIG. 10.
Figure 12B:
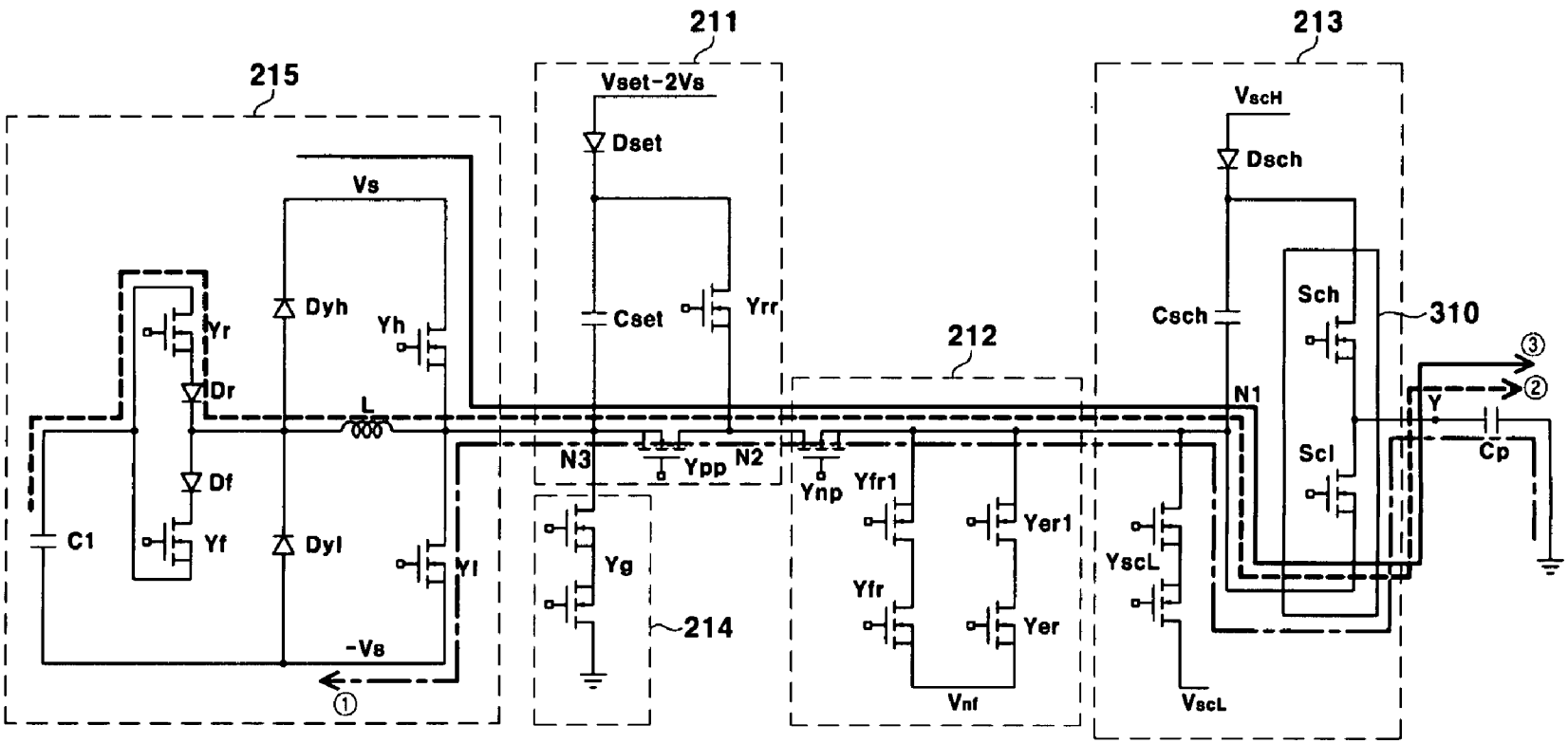

FIGS. 11A, 11B, 12A, and 12B show a method for generating driving waveforms during the sustain and the reset periods, Ps, Pr. FIGS. 11A and 11B show current paths for generating driving waveforms during the sustain period Ps in the driving circuit of FIG. 10. FIGS. 12A and 12B show current paths for generating driving waveforms during the reset period Pr in the driving circuit of FIG. 10.

As shown in FIG. 11A, during the sustain period Ps the transistor Sch is turned off and the transistors Yh, Ypp, Ynp, and Scl are turned on so as to increase the voltage of the Y electrode up to the voltage Vs (path ②) from a state in which the non-scan voltage Vsch was applied to a Y electrode that was not selected during the address period Pa. Prior to turning off the Sch transistor, while the transistor Sch (path ①) was on during the address period Pa, the voltage of the Y electrode was Vsch. Subsequent to turning off the Sch transistor, the transistor Yh is turned off and the transistor Yl is turned on so as to decrease the voltage of the Y electrode down to −Vs (path ③). By repeating such operations (i.e., path ② and path ③), the sustain discharge pulse that oscillates between the voltage Vs and the voltage −Vs may be applied to the Y electrode.

LC resonance can be used to vary the voltage of the Y electrode instead of the voltages Vs or −Vs that are applied to the Y electrode by a hard switching in FIG. 11A. As shown in FIG. 11B, the transistors Yr, Ypp, Ynp, and Scl are turned on to generate a resonance between the inductor L and the panel capacitor Cp to increase the voltage of the Y electrode up to the voltage Vs (path ②), from a state in which the non-scan voltage Vsch was applied to a Y electrode that was not selected during the address period Pa by turning on the transistor Sch (path ①). Subsequently, the transistor Yr is turned off and the transistor Yh is turned on so as to maintain the voltage of the Y electrode at the voltage Vs.

Afterward, from the state in which the voltage of the Y electrode is maintained at the voltage Vs, the transistor Yf is turned on so that the current flows along a path in reverse to path ②, and the voltage of the Y electrode is decreased down to −Vs by a resonance generated between the inductor L and the panel capacitor Cp (path ③). Subsequently, the transistor Yf is turned off and the transistor Yl is turned on so as to maintain the voltage of the Y electrode at the voltage −Vs.

As shown in FIG. 12A, from a state in which the −Vs voltage of a final sustain discharge pulse is applied to the Y electrode during the sustain period (path ①), the transistor Yl is turned off and the transistor Yh is turned on so as to increase the voltage of the Y electrode up to the voltage Vs (path ②). Subsequently, the transistor Yrr is turned on and the transistor Ypp is turned off so as to apply a voltage gradually increasing from the voltage Vs to the voltage Vset to the Y electrode (path ③). At this time, the voltage of the Y electrode is increased up to Vset by the power source of the voltage Vs and the capacitor Cset with the voltage Vset-Vs.

In order to increase the voltage of the Y electrode up to the voltage Vs from a state in which a final sustain pulse of the −Vs voltage is applied to the Y electrode, LC resonance can be used to vary the voltage of the Y electrode (path ② of FIG. 12B) instead of hard switching of path ② of FIG. 12A.

As shown in FIG. 12B, from the state in which the voltage −Vs of the final sustain discharge pulse is applied to the Y electrode(path ①), the transistor Yr is turned on such that the voltage of the Y electrode is increased up to the voltage Vs by the resonance generated between the inductor L and the panel capacitor Cp (path ②). Subsequently the transistor Yr is turned off and the transistor Yh is turned on so as to maintain the voltage of the Y electrode at the voltage Vs(path ③).

In the driving circuits shown in FIG. 10, FIG. 11A, FIG. 11B, FIG. 12A, and FIG. 12B, the voltage of the Y electrode is gradually increased from the voltage Vs to the voltage Vset by the voltage created across the capacitor Cset during the reset period Pr. However, capacitor Cset may be removed as shown in FIG. 13.

Figure 13:
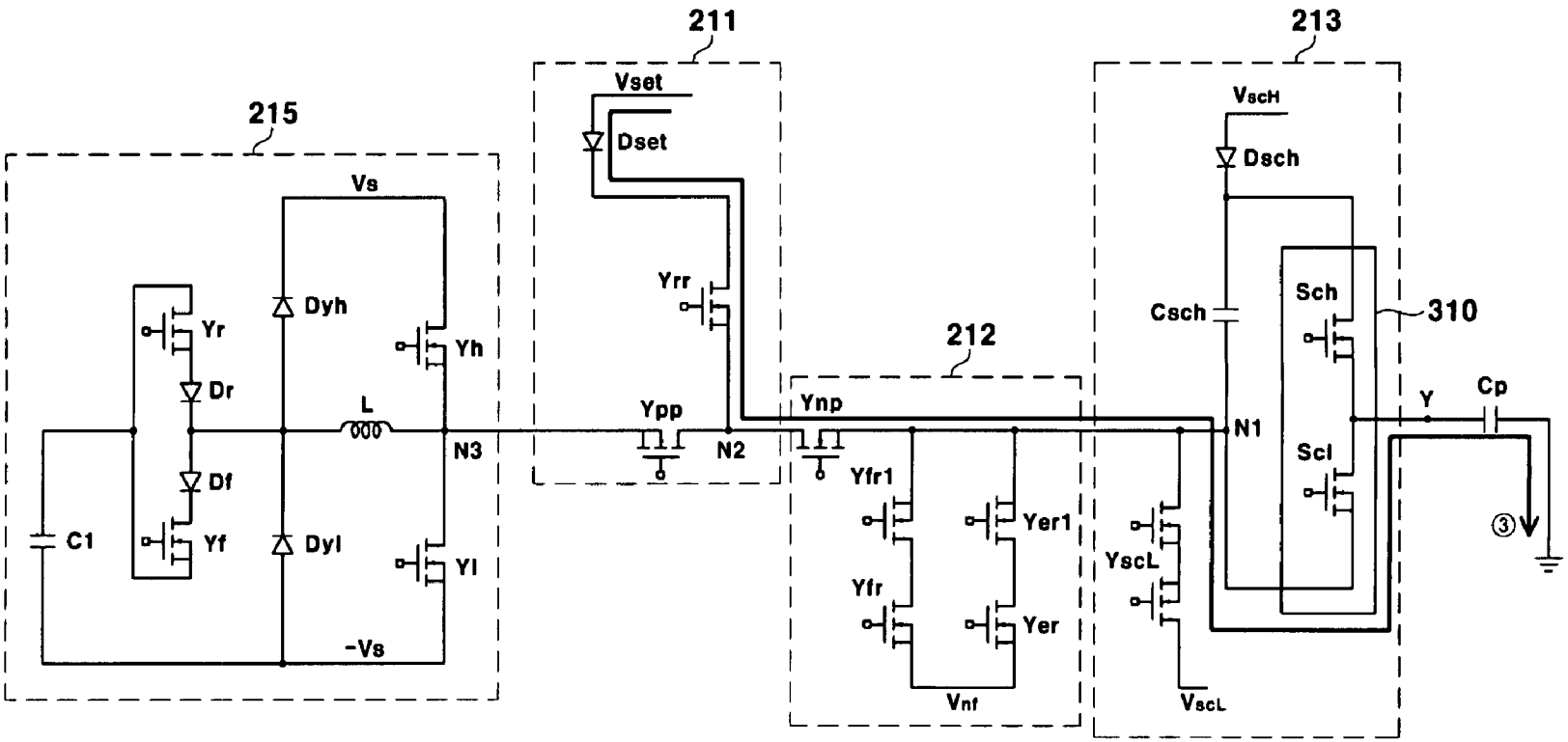
FIG. 13 shows another exemplary driving circuit for generating the driving waveforms of FIG. 9.

FIG. 13 shows a second exemplary driving circuit for generating the driving waveforms of FIG. 9. The driving circuit shown in FIG. 13 is similar to the circuit shown in FIG. 10, except that in FIG. 13 a power supply of the voltage Vset is coupled to the N2 through the transistor Yrr and the capacitor Cset is removed. In this embodiment, after the voltage Vs is applied to the Y electrode during the reset period Pr, one of the switching elements Yr or Yh is turned off and the switching element Yrr is turned on so as to supply the Vset voltage to the Y electrode (path ③).

Although the driving circuit is designed as a power recovery circuit to reclaim and reuse the power of a panel capacitor Cp shown in FIGS. 10, 11A, 11B, 12A, 12B, and 13, the present invention may choose to forego such the power recovery function. That is, the capacitor C1 may be eliminated. An embodiment without such a capacitor C1 will is shown in FIG. 14.

Figure 14:
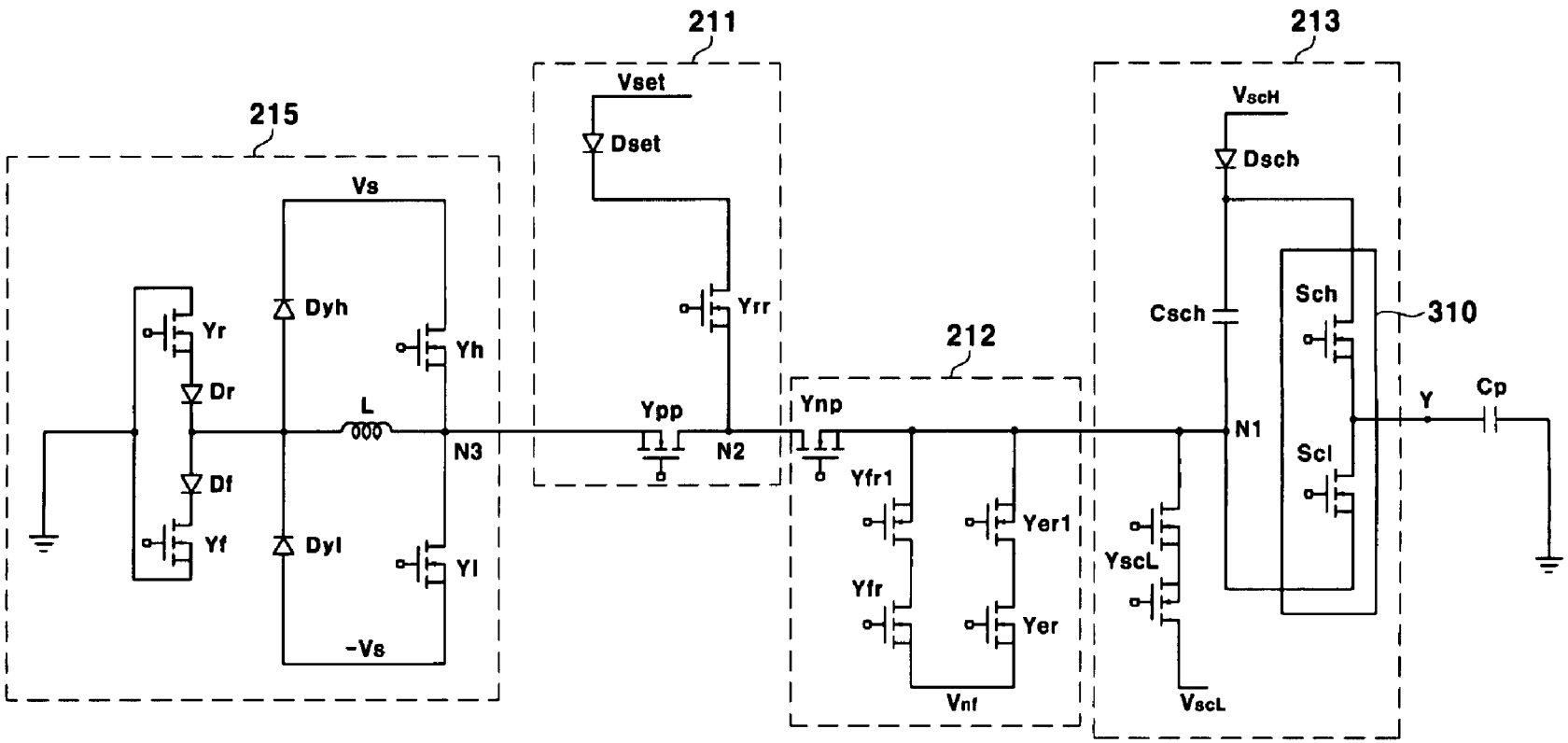
FIG. 14 shows a third exemplary driving circuit for generating the driving waveforms of FIG. 9.

FIG. 14 shows a third exemplary driving circuit for generating the driving waveforms of FIG. 9. The driving circuit is similar to the driving circuit shown in FIG. 10. However, the connection between the drain of the transistor Yr and the source of the transistor Yf is grounded by removing capacitor C1. Otherwise, the driving circuit may operate as already described.

As described above, according to an exemplary embodiment of the present invention, the reset operation, the address operation, and the sustain discharge operation can be preformed by applying the driving waveform to only the Y electrode while the X electrode is biased at a constant voltage. Accordingly, a driving board for driving the X electrode is not necessarily required. Also, because the pulse for the sustain discharge is supplied to only the scan driving board 300, the impedance may become uniform in paths to which the sustain discharge pulses are applied.

Further, although both of the rising period Pr1 and the falling period Pr2 may be included in every reset period Pr, it is notable that some reset periods Pr may be formed with only the falling period Pr2 without the rising period Pr1. Such an embodiment in which the reset period Pr is formed with only the falling period Pr2 is shown in FIG. 15.

Figure 15:
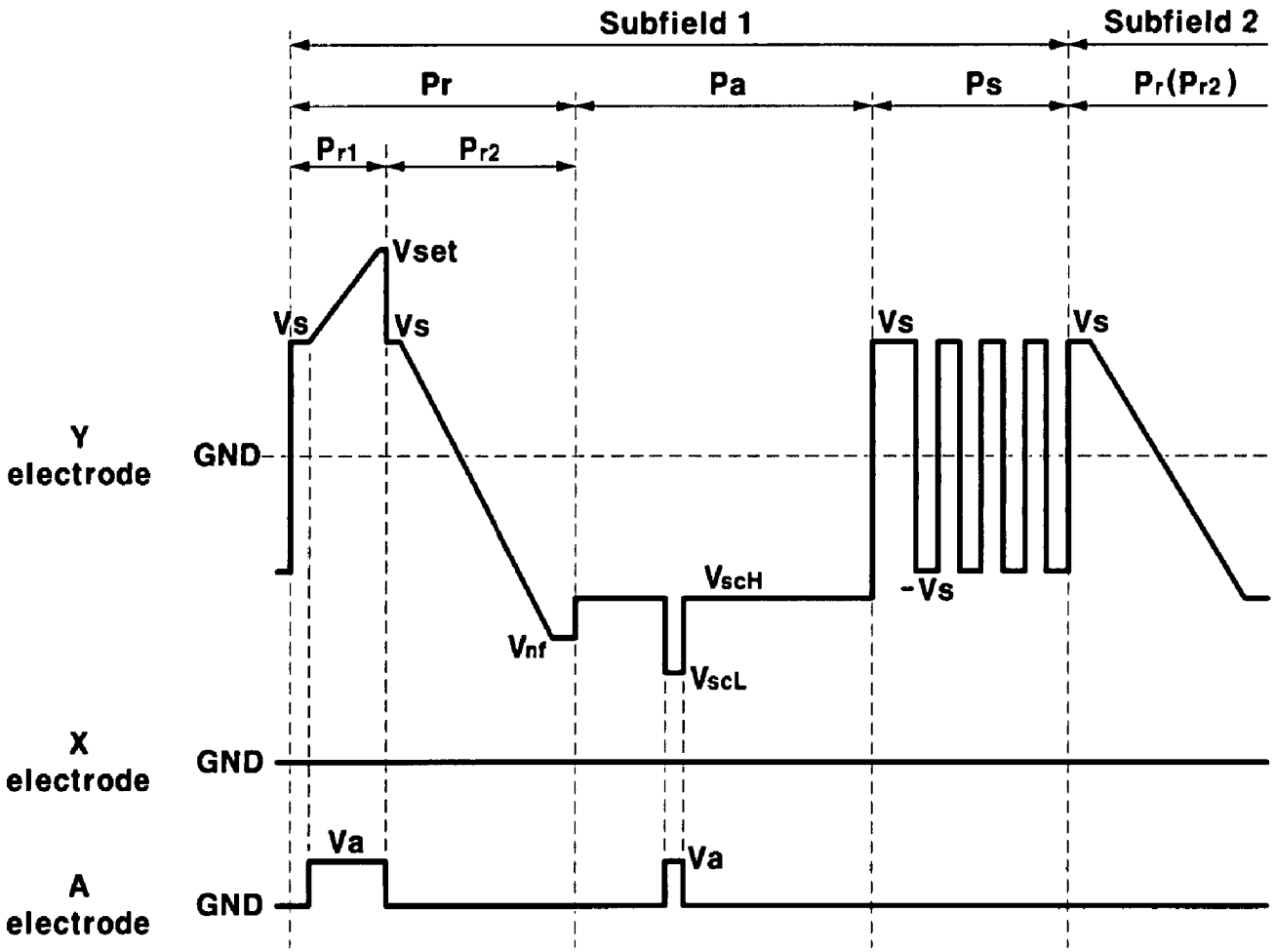
FIG. 15 shows driving waveforms according to a fourth exemplary embodiment of the present invention.

FIG. 15 shows driving waveforms according to a fourth exemplary embodiment of the present invention. For better understanding and convenience of description, this figure shows only two subfields which are denoted as first and second subfields. The reset period Pr of the first subfield is formed with a rising period Pr1 where the voltage of the Y electrode is gradually increased from Vs to Vset, and a falling period Pr2 where the voltage of the Y electrode is gradually decreased from Vs to Vnf. The reset period Pr(Pr2) of the second subfield is formed with only a falling period Pr(Pr2), during which the voltage of the Y electrode is gradually decreased from Vs to Vnf. Therefore, only a falling ramp waveform is applied during the reset period Pr(Pr2) of the second subfield while a rising waveform is applied prior to a falling ramp waveform during the reset period Pr of the first subfield.

When sustain discharge has been generated during the sustain period Ps of the first subfield or subfield 1, negative (−) wall charges are formed on the Y electrode and positive (+) wall charges are formed on the A and X electrodes. The voltage of the Y electrode added to the wall voltage formed in the cell exceeds the discharge firing voltage while the voltage of the Y electrode is gradually decreased, and a weak discharge is generated similar to that generated during the falling period Pr2 of the first subfield. Also, because the final voltage Vnf of the Y electrode is the same as the final voltage Vnf of the falling period Pr2 of the first subfield, the state of the wall charge at the end of the falling period Pr(Pr2) of the second subfield is equivalent to the state of the wall charge at the end of the falling period Pr2 of the first subfield.

When sustain discharge does not occur during the sustain period Ps of the first subfield, because address discharge does not occur during the address period Pa, the wall charge state is maintained at a constant level equal to the level at the end of the falling period Pr2 of the first subfield. The wall voltage at the end of the falling period Pr2 of the first subfield is near the discharge firing voltage when added to the applied voltage. Therefore, a discharge is not generated when the voltage of the Y electrode is decreased down to the voltage Vnf. As a result, a discharge is not generated during the reset period Pr(Pr2) of the second subfield and the wall charge formed during the reset period of the first subfield Pr is maintained.

As mentioned above, regarding a subfield that has only a falling period, a reset discharge is generated when a sustain discharge was generated in a previous subfield, and the reset discharge is not generated when the sustain discharge was generated in the previous subfield. Accordingly, when a first-occurring subfield in a frame is designed as the first subfield of FIG. 15, including both rising and falling periods Pr1, Pr2, and the subsequent subfields are designed as the second subfield of FIG. 15, including only a falling period Pr(Pr2), the reset discharge (weak discharge) may occur during only the first subfield in the case of displaying 0 grayscale (black grayscale). That is, a reset discharge is prevented from occurring during the subsequent subfields in the case of displaying a black grayscale hence improving the contrast.

As described above, according to an embodiment of the present invention, a board for driving the X electrode may become unnecessary since the driving waveform may be applied only to the Y electrode while the X electrode is biased at a constant voltage. That is, a single combined board can be used and the driving switch of driving circuit can be eliminated, thereby reducing the manufacturing cost.

When the Y electrodes and the X electrodes are driven by separate driving boards, different impedances are formed in the scan driving board and sustain driving board because driving waveforms in the reset period Pr and the address period Pa are mainly supplied from the scan driving board. Accordingly, the sustain discharge pulse applied to the Y electrode and the sustain discharge pulse applied to the X electrode during the sustain period Ps may become different. However, according to an embodiment of the present invention, the impedance can stay uniform because the pulse for the sustain discharge is supplied only by the scan driving board.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel, the plasma display panel including scan electrodes, sustain electrodes, and address electrodes, arranged in a matrix form, the scan electrodes and the sustain electrodes forming parallel pairs and the address electrodes extending perpendicular to the scan electrodes and the sustain electrodes, the method driving the plasma display panel during frames, each frame having subfields, each subfield having a reset period followed by an address period followed by a sustain period, the reset period including a rising period followed by a falling period, the method comprising:

biasing the sustain electrodes at a first voltage during all periods of each subfield;

applying a negative second voltage to non-selected electrodes of the scan electrodes and a third voltage more negative than the second voltage to selected electrodes of the scan electrodes during the address period;

increasing the voltage of the scan electrodes from the negative second voltage to a positive fourth voltage at an end of the address period and a beginning of the sustain period; and alternately applying a negative fifth voltage and the positive fourth voltage to the scan electrodes during the sustain period, wherein during at least a portion of the rising period of the reset period a voltage of the address electrodes is higher than a voltage of the sustain electrodes.

2. The method of claim 1, further comprising:

applying a positive sixth voltage to the scan electrodes after the negative fifth voltage is applied to the scan electrodes, at an end of the sustain period and a beginning of the reset period of a subsequent subfield; and gradually increasing the voltage of the scan electrodes from the positive sixth voltage to a seventh voltage during the rising period of the reset period of the subsequent subfield.

3. The method of claim 2, further comprising:

decreasing the voltage of the scan electrodes from the seventh voltage to a positive eighth voltage at a beginning of the falling period of the reset period of the subsequent subfield; and gradually decreasing the voltage of the scan electrodes from the positive eighth voltage to a negative ninth voltage during the falling period of the reset period of the subsequent subfield.

4. The method of claim 1, further comprising:

applying a positive sixth voltage to the scan electrodes after the negative fifth voltage is applied to the scan electrodes at an end of the sustain period and a beginning of the reset period of a subsequent subfield; and gradually decreasing the voltage of the scan electrodes from the positive sixth voltage to a negative seventh voltage during the reset period of the subsequent subfield.

5. The method of claim 2, wherein the positive sixth voltage is equal to the positive fourth voltage.

6. The method of claim 1, wherein an absolute value of the positive fourth voltage is equal to the absolute value of the negative fifth voltage.

7. The method of claim 1, wherein the first voltage is a ground voltage.

8. The method of claim 1, wherein an address pulse of a positive voltage is applied to the address electrodes during the address period.

* * * * *